US005836095A

United States Patent [19]

Crowell

[11] Patent Number: 5,836,095

[45] Date of Patent: Nov. 17, 1998

[54] DECORATIVE, VISUALLY STIMULATING DISPLAY AND ARTICLE HOLDING SYSTEM

[76] Inventor: Christopher S. Crowell, 80 Plains Rd., Essex, Conn. 06426

[21] Appl. No.: 821,106

[22] Filed: Mar. 20, 1997

Related U.S. Application Data

[62] Division of Ser. No. 342,256, Nov. 18, 1994, Pat. No. 5,613,312.

[51] Int. Cl.[6] ..... G09F 3/10

[52] U.S. Cl. ..... 40/299; 40/312; 383/111; 383/106

[58] Field of Search ..... 40/299, 312, 124.06, 40/538, 539, 308, 324; 383/7, 10, 105, 106, 111; 229/922, 165, 180, 181; 206/457

[56] References Cited

U.S. PATENT DOCUMENTS

| | | | |
|---|---|---|---|
| 1,509,776 | 9/1924 | Plimpton | 40/124.06 X |
| 1,866,493 | 7/1932 | Staats | 40/312 |
| 2,920,671 | 1/1960 | Siris et al. | 383/106 X |
| 3,131,848 | 5/1964 | Floyd | 229/181 X |
| 3,348,759 | 10/1967 | Johnson | 40/312 X |
| 3,440,747 | 4/1969 | Oliver | 40/312 X |
| 3,818,963 | 6/1974 | Whitman | 383/106 X |
| 4,784,314 | 11/1988 | Penick | 40/312 X |
| 4,953,779 | 9/1990 | Densen | 40/312 X |
| 5,001,853 | 3/1991 | Odien | 40/312 X |
| 5,226,576 | 7/1993 | Ellsworth | 383/111 X |
| 5,326,575 | 7/1994 | Spaulding | 383/111 X |
| 5,613,312 | 3/1997 | Crowell | 40/299 X |

*Primary Examiner*—Peter M. Cuomo
*Assistant Examiner*—James O. Hansen
*Attorney, Agent, or Firm*—Melvin I. Stoltz

[57] ABSTRACT

An exciting, visually distinctive display and article holding system is provided by incorporating one or more extendable portions, flaps or members on the surfaces of a bag or box structure with both the bag or box and the extendable portions, flaps, or members incorporating unique, cooperating visually exciting indicia thereon. Preferably, the display and article holding system is foldable for easy storage or, if desired, formed from heavy or thick material to enable the article holding system to form a display. In one embodiment, the display and article holding system is constructed in a multi-dimensioned size and shape consistent with an animal, character, or object being represented thereby, with the surfaces thereof incorporating indicia depicting the desired character, animal or object. In alternate embodiments, movable panels, flap members, or card-holding members are employed to provide a unique, visually exciting article holding system.

9 Claims, 15 Drawing Sheets

Fig.23
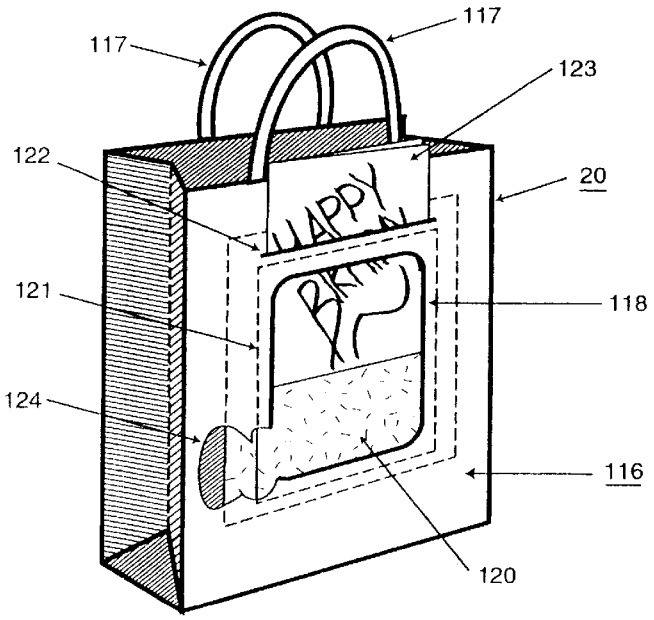
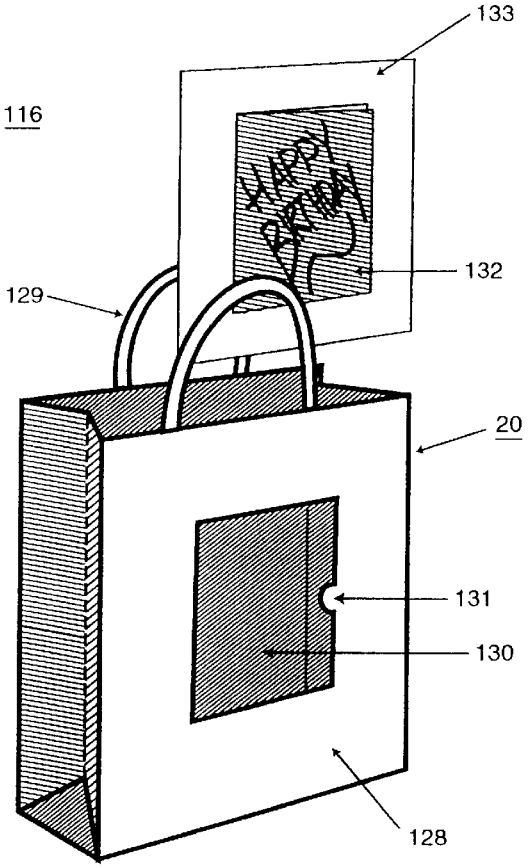
Fig.24
Fig.25
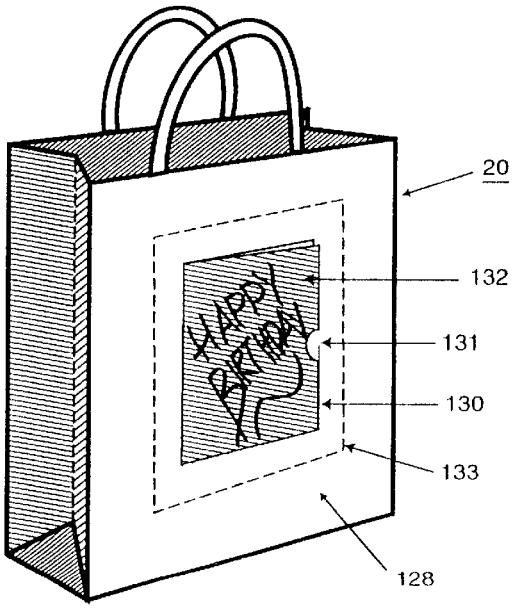

Fig.28
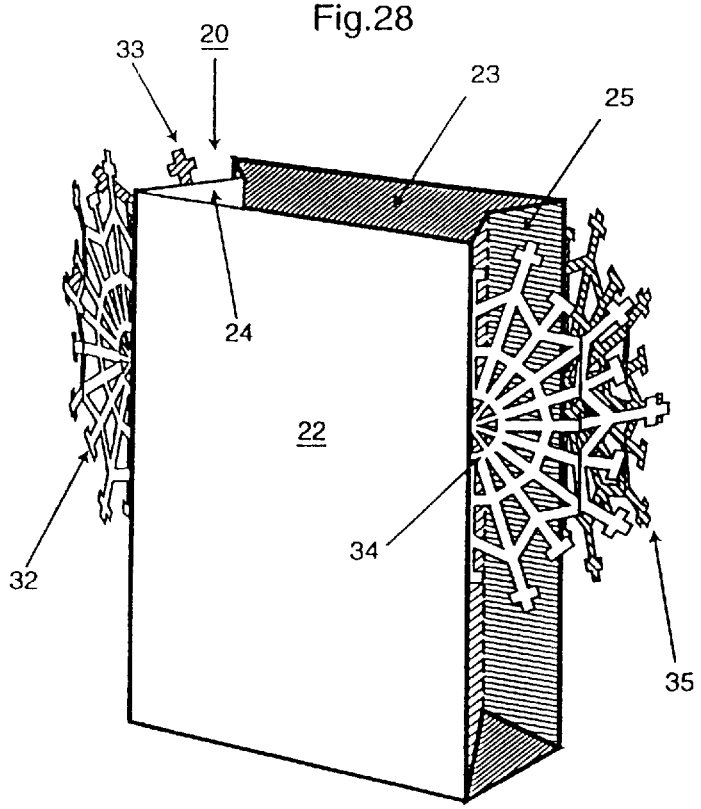
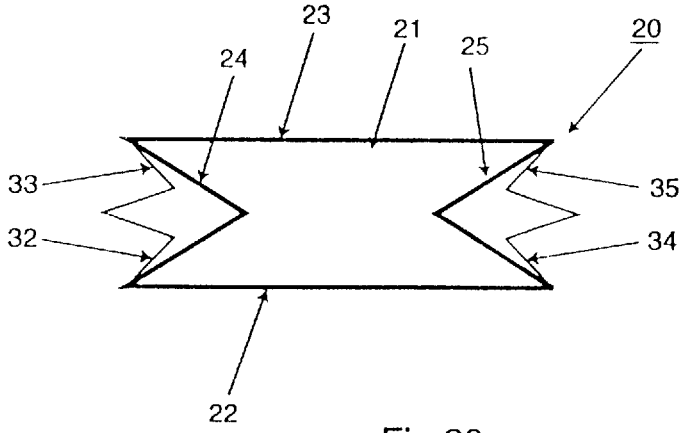
Fig.29

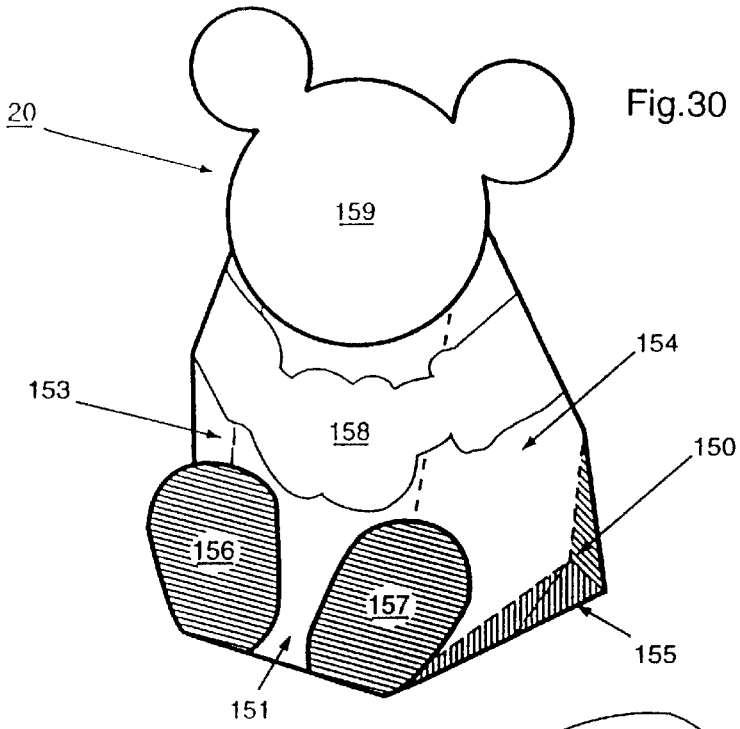
Fig.30
Fig.31
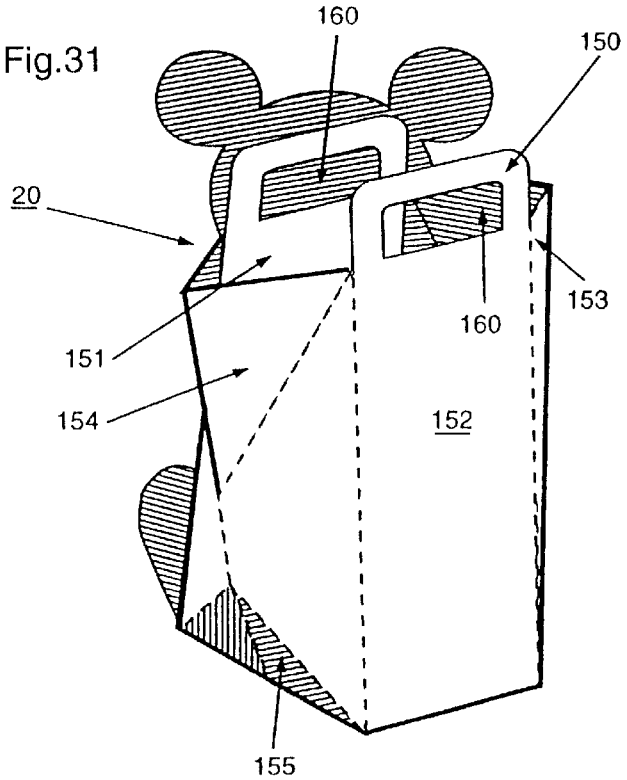
Fig.32
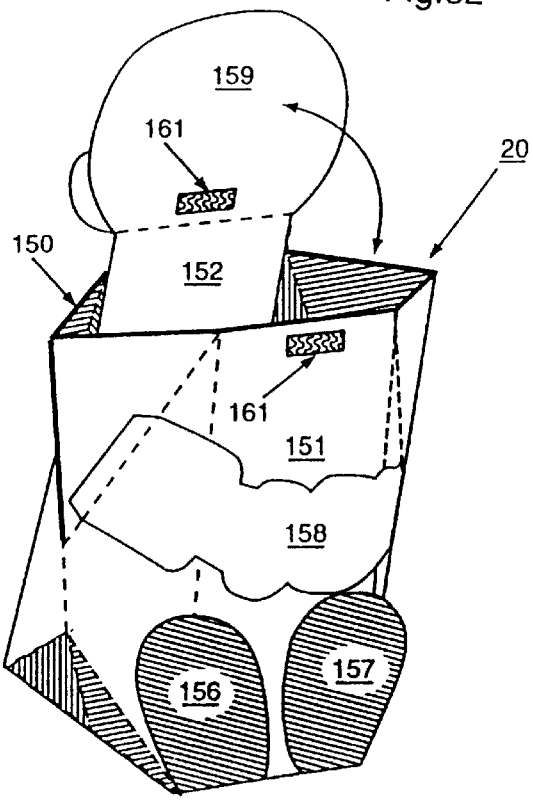

DECORATIVE, VISUALLY STIMULATING DISPLAY AND ARTICLE HOLDING SYSTEM

This application is a division of application Ser. No. 08/342,256, filed Nov. 18, 1994 now U.S. Pat. No. 5,613, 312.

TECHNICAL FIELD

This invention relates to constructions for gift holding systems and, more particularly, to unique holding systems constructions which incorporate highly visible, visually distinctive indicia associated therewith for adding excitement and interest to the holding system.

BACKGROUND ART

In order to promote a festive or joyous atmosphere and impression, it is traditional that gifts given from one person to another are wrapped in a suitable decorative manner. In this way, the joyous occasion or event for which the gift is intended to commemorate is enhanced. Typically, gifts are placed in a box which is then wrapped in suitable decorative paper consistent with the event being celebrated. In addition to the use of boxes in wrapping paper, more recently, gifts have been placed in brightly colored or decorated bags, with the bag serving as the festive, visually exciting medium for the recipient.

Although the use of gift bags has become increasingly popular, the bags are formed in a general conventional manner having a front panel and a rear panel integrally connected with two side panels, with the side panels constructed for folding to enable the bag to be stored flat until its use is desired. In addition, handle members are also often incorporated on the front and rear panels for assisting in holding the bag along with its contents.

In spite of the increased popularity and use of gift bags, the gift bag construction has not been changed from conventional bags. Presently, only varying colors and surface pictures or designs are employed on the outer surface of the bag to provide the enhanced, visually exciting and pleasing appearance, with some bags employing overlays on one surface. However, no structural alterations are incorporated in any prior art bag in an attempt to expand its visually appeal or its functional purpose. Similarly, gift boxes have remained unchanged in appearance, relying on decorative wrapping paper to provide the desired visual appeal.

Therefore, it is a principal object of the present invention to provide a unique article holding system which can be employed as either an article holding bag or an article holding box and provides a substantially enhanced visual appearance.

Another object of the present invention is to provide a unique article holding system having the characteristic features described above which is capable of being folded in a generally conventional manner for ease of storage, while also incorporating a unique, visually expansive appearance when unfolded.

Another object of the present invention is to provide a unique article holding system having the characteristic features described above which is capable of incorporating a wide variety of visually stimulating indicia on the surfaces thereof as well as capable of having alterable visual images integrally associated therewith.

Another object of the present invention is to provide a unique article holding system having the characteristic features described above which incorporates indicia on the outside surface of the bag or box which extends beyond the physical dimensions of the bag or box, providing a visually enhanced and distinctive appearance.

Other and more specific objects will in part be obvious and will in part appear hereinafter.

SUMMARY OF THE INVENTION

By employing the teaching of the present invention, all of the difficulties, drawbacks and limitations of the prior art box or bag constructions are overcome, a unique, distinctive, and visually exciting enhanced multi-dimensional display and article holding system is realized. In addition, by employing the present invention, numerous alternate visually distinctive constructions are attainable.

The present invention attains an exciting visually enhanced appearance by incorporating one or more extendable portions, flaps, or members positioned in cooperative association with the conventional bag or box construction. By incorporating one or more extendable portions, flaps, or members, as taught herein, a unique, distinctive, visually exciting and aesthetically pleasing display and article holding system is realized, attaining a level of interest and excitement which heretofore has been unattainable with conventional gift bags or boxes.

As discussed above, in most prior art gift bag/box constructions, the outer surface of the bag/box is brightly colored, or decorated or covered in decorative paper in an attempt to generate interest and excitement. Typically, these prior art bags/boxes merely incorporate visually pleasing designs, shapes, or figures printed on the outside surface of the bag/box or wrapping paper. However, in each instance, these prior art constructions are specifically limited to visual presentations formed on the bag/box surface within the dimensional confines of each panel of the bag/box surface. In addition, all of the visual indicia placed on prior art bag/box constructions are static in appearance, insofar as they are incapable of being altered or changed in any way by either the consumer or the gift recipient.

In the present invention, all of these limitations and drawbacks are completely overcome and a dynamic, visually pleasing, multi-dimensional display and article holding system is realized which is also capable of presenting a visual image or indicia extending beyond the dimensional confines of the bag/box construction itself. As a result, a unique, visually distinctive, highly pleasing and commercially desirable bag/box and display construction is realized.

In addition, since individuals are constantly looking for unique and novel ways in which to present a gift, such individuals often seek to match personalities, themes, animals, and comical subjects, etc. in a distinctive way in providing a gift to a recipient. Through the use of the novel display and article holding system of this invention, pleasure, imagination, and creativity can be expanded to both the person giving the gift as well as the person receiving the gift.

In one embodiment of the present invention, visually distinctive indicia are formed on the enlarged decorative front and rear panels which form the overall bag/box construction. If desired, these indicia can be identical or can be completely different visual representations of any desired subject matter. Typically, an object, scenery, character, animal, sporting event, etc. is depicted on the bag/box.

In order to provide a unique and visually distinctive image, a separate member, portion, or flap is mounted along at least one side edge of the front panel, with the member, portion, or flap incorporating indicia thereon which is related to the indicia appearing on the front portion of the panel. In addition, the indicia on the flap panel or member is constructed to be consistent with the indicia appearing on the front panel and, preferably, represent an integral part of the indicia. If desired, a second member, portion or flap can be mounted along the opposed side edge of the front panel of the bag, representing a further extension of the indicia appearing on the bag or box.

By employing this construction, any desired visual image can be placed on the front panel of a bag or box, with the visual image appearing to extend beyond the side edges of the panel of the bag/box. For example, if an animal, such as a cat, dog, bear, etc. is depicted on the front panel of the bag/box, the extending flap, member, or portion constructed for blended cooperation with the image appearing on the bag/box panel itself may incorporate a portion of the head of the animal. In this way, a visual impression is presented that the animal depicted on the panel of the bag/box has its head extending beyond the side edge of the bag/box. Similarly, if a second flap portion is also employed, the hind area or tail of the animal can be depicted extending beyond the opposed side edge of the bag/box. As a result, a unique, visually distinctive and exciting visual impression is attained, completely departing from any prior art construction presently existing.

In addition to employing the extending flaps on one or both side edges of the front panel, the rear or back panel of the bag/box can also be constructed in a substantially identical manner. In this way, both the front and rear panels incorporate visual images of any desired indicia, with the indicia visually appearing to extend beyond the side edges of the bag/box. In this way, a totally unique and pleasing visual impression is created.

In the preferred construction, extending flaps, members or portions are employed on both the front and rear panels of the bag/box, with the extending flaps being present on both side edges of both panel portions. In this way, the flaps, members or portions cooperating with both the front and rear panels of the bag/box on each side thereof can be affixed to each other, preferably by securing the ends of the flap together. As a result, a substantially V-shaped flap extension is formed on each side of the bag/box, with the ends of the "V" mounted to the side panels of the bag/box, in the desired position, in cooperative, aligned, visual extending alignment with the indicia appearing on the bag/box panels. By employing this construction, a highly unique, visually pleasing bag/box display construction is realized which is capable of providing virtually any desired visual image in a completely unanticipated, multi-dimensional aesthetically exciting manner.

In an alternate embodiment, the unique visually distinctive display/bag of the present invention is achieved using a conventional bag construction in combination with an indicia bearing overlay mounted to the outer surface of the bag and incorporating the desired indicia printed thereon, along with extendable flaps, members or portions integrally associated therewith and forming a part of the overlay construction. By employing this embodiment, any conventional bag can be quickly and easily converted into a unique, exciting, visually distinctive gift bag and display which provides the enhanced visual presentation attained by the present invention.

In a further embodiment of the present invention, the overall dimensions of a conventional bag or box are retained with at least one panel of the bag/box being formed with cut-out zones incorporated therein. In addition, the cut-out zones are cooperatively associated with a movable panel member positioned behind the visible panel member, and preferably cooperatively associated therewith. In this way, either pre-printed or personalized messages are incorporated on the movable panel member, with the messages being alterably displayable to the recipient by changing the position of the movable panel member relative to the open zone of the panel member.

By employing this construction, particular occasions, such as birthdays, anniversaries, weddings, etc. can be displayed on the panel member itself with an alterable message insertable by the gift provider on the movable panel or, alternatively, the event displayed on one portion of the panel and, when the panel is moved, the name or names of the recipient or a pre-printed message is displayed. As is evident from this disclosure, numerous alternate combinations of features or arrangement of phraseology can be employed without departing from the scope of this invention.

In addition to displaying different messages through the open zone of the panel, with the messages being alternately visible by moving the panel member, various other stimulating, exciting and visually distinctive constructions can be attained employing this concept. Such alternate constructions include displaying, on at least one panel member, any desired indicia with open zones formed as part of the indicia. In addition, complementary indicia is formed on the movable panel and positioned for being alternately displayed through the open zones. By altering the position of the movable panel, a totally different effect or stimulating visual change is realized in an easily employed, unique construction. As a result, the present invention attains a totally different, unique and exciting bag/box construction for enhancing the excitement being realized by a recipient of the bag/box as well as the gift contained in the bag/box.

In a final general alternate embodiment of the present invention, a unique bag/box and display construction is attained by forming the bag/box with at least two separate and distinct segments, each of which are cooperatively associated with the other to produce a telescopically extendable bag/box construction. In this way, a bag/box having a conventional overall dimension is effectively able to extend, typically in either a vertical or horizontal direction, by axially moving one segment of the bag/box relative to the other segment or segments. By incorporating indicia on the bag/box which indicia is designed for cooperative association with the extendable features of this bag/box construction, a unique, visually distinctive, commercially desirable display and article holding system is attained.

As discussed above, the indicia placed on the telescopically extendable bag/box construction may comprise any desired subject matter. As an example, a cartoon character can appear on the surface of the bag/box which, in its first unextended position, visually represents a generally conventional body. Then, by telescopically extending the bag segments relative to each other, the indicia is constructed to appear to present a character which is growing or stretching in length as the bag/box segments telescopically separate into its second fully extended position. In this way, a comical, interesting, unique and exciting bag/box and display construction is realized.

In this embodiment of the present invention, any number of segments can be employed to attain the desired fully extended bag/box construction. Preferably, the segments are cooperatingly associated and interlocked with each other in order to prevent unwanted removal or separation of one bag/box segment from another. By incorporating an interlocking system, the desired repeatable use of the bag/box construction is attained and the unique visually distinctive display aspects of the present invention are preserved and repeatedly enjoyed.

The invention accordingly comprises an article of manufacture, possessing the features, properties, and relation of elements which will be exemplified in the articles hereinafter described and the scope of the invention will be indicated in the claims.

THE DRAWINGS

For a fuller understanding of the nature and objects of the invention, reference should be had to the following detailed description taken in connection with the accompanying drawings in which:

FIG. 23 is a front elevation view of an alternate embodiment of the article holding system of the present invention incorporating a holding assembly integrally formed therewith for securely holding and displaying any desired greeting or message bearing card;

FIG. 24 is a front elevation view of a still further alternate embodiment of the article holding system of the present invention incorporating an alternate construction securely retaining and visually displaying any desired greeting or message bearing card, depicted with the card removed;

FIG. 25 is a front perspective view of the article holding system of FIG. 24 depicting the card securely mounted in direct association with the article holding system;

FIG. 28 is a front perspective view of a further alternate embodiment of the present invention incorporating extendable side flaps integrally formed therewith; and FIG. 29 is a top plan view of the article holding system of FIG. 28 depicted in the process of being folded with the flap portions fully stowed therewith.

FIG. 30 is a front elevation view of a further alternate embodiment of the article holding system of the present invention wherein the holding system is constructed to visually represent, in its entirety, a particular character, animal, or object;

FIG. 31 is a rear perspective view of the article holding system of FIG. 30;

FIG. 32 is a front perspective view of an alternate construction for the embodiment of the article holding system depicted in FIG. 30;

Figure 39:
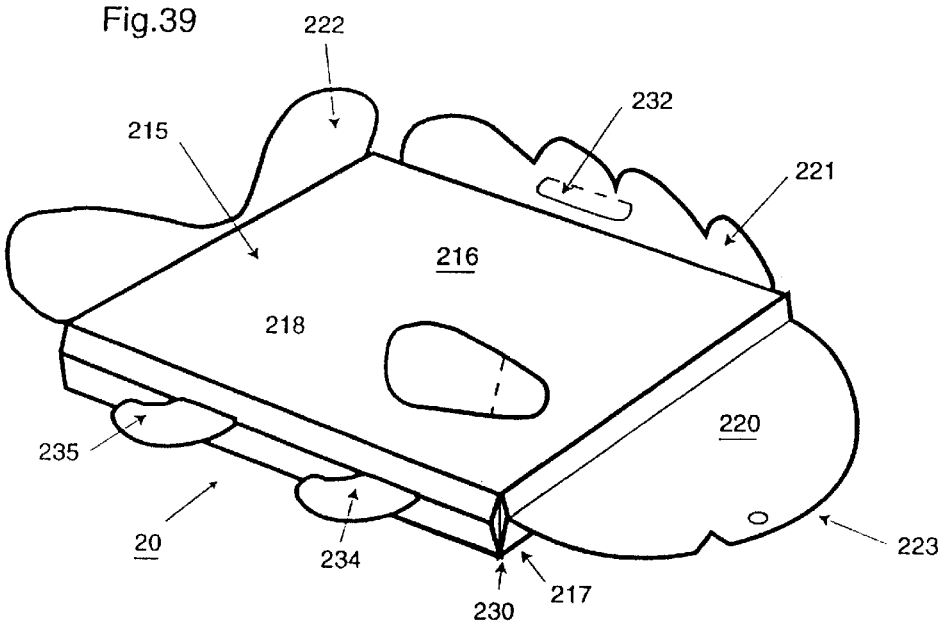
FIG. 39 is a front perspective view of a still further alternate embodiment of the present invention depicting a fully assembled article holding system configured as an animal, character, or object in a substantially box-like structure.
Figure 40:
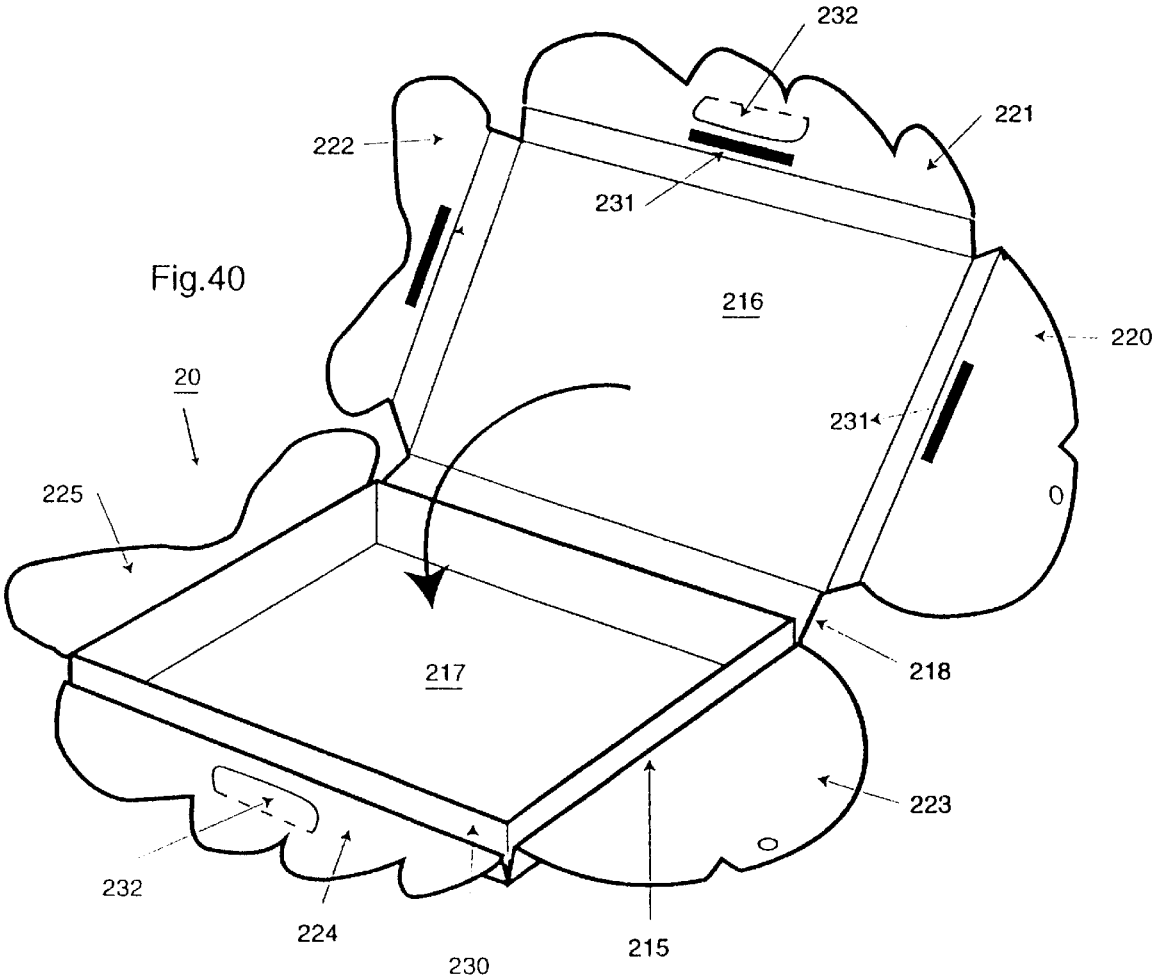
Figure 41:
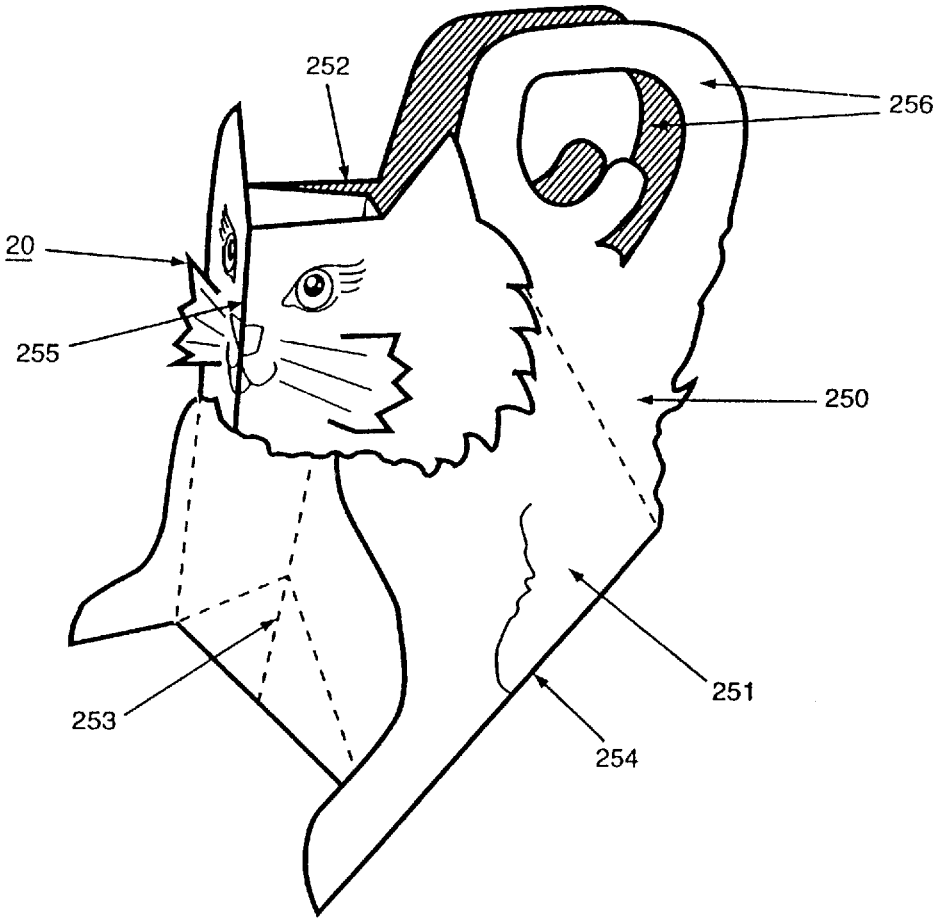

FIG. 40 is a front elevation view of the article holding system of FIG. 39 depicted in its open configuration, so as to fully detail the box-like structure; and FIG. 41 is perspective view of a still further alternate embodiment of the article holding system of the present invention wherein the holding system is constructed to visually represent, in its entirety, a particular character, animal, or object.

DETAILED DESCRIPTION

By referring to FIGS. 1–29, along with the following detailed disclosure, the construction and operation of various alternate embodiments of the present invention can best be understood. As is evident from this disclosure, the unique, visually exciting, display and item holding system of the present invention can be achieved in numerous alternate constructions and configurations. In order to provide a complete disclosure of the present invention, various alternate embodiments of the present invention are depicted in the drawings and detailed herein. However, these embodiments are presented as examples of the present invention and it is to be understood that the scope of the present invention is not intended to be limited to these specific embodiments.

In FIGS. 1–7, one embodiment of display and article holding system 20 of the present invention is depicted. In this embodiment, system 20 comprises a generally conventionally constructed, article holding receptacle 21 which is formed with front panel 22, rear panel 23, and side panels 24 and 25.

Figure 5:
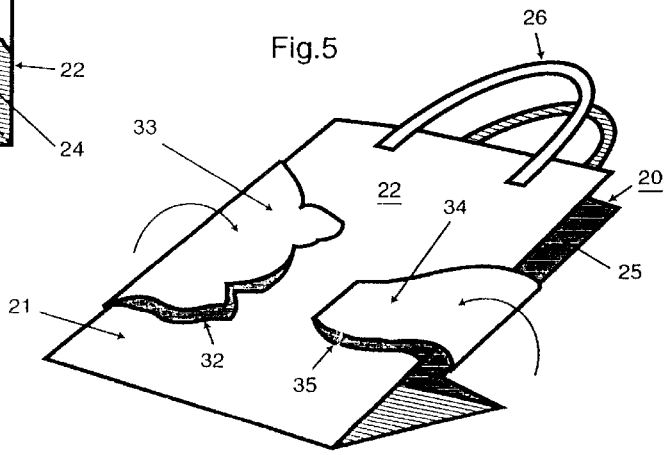
FIG. 5 is a perspective view of the system of FIG. 1, depicting the system in its folded configuration.

As is well known in the art, the panels forming article holding receptacle 21 are all integrally connected to each other with side panels 24 and 25 constructed with foldable creases formed therein in order to enable article holding receptacle 21 to be easily opened for use or folded for convenient storage. This folded configuration is shown in FIG. 5.

The overall construction of article holding receptacle 21 is completed in its preferred embodiment, by securely affixing handle 26 to front panel 22 and handle 27 to rear panel 23. In this way, system 20 of the present invention can be easily held by the user, with the desired articles placed therein.

Figure 1:
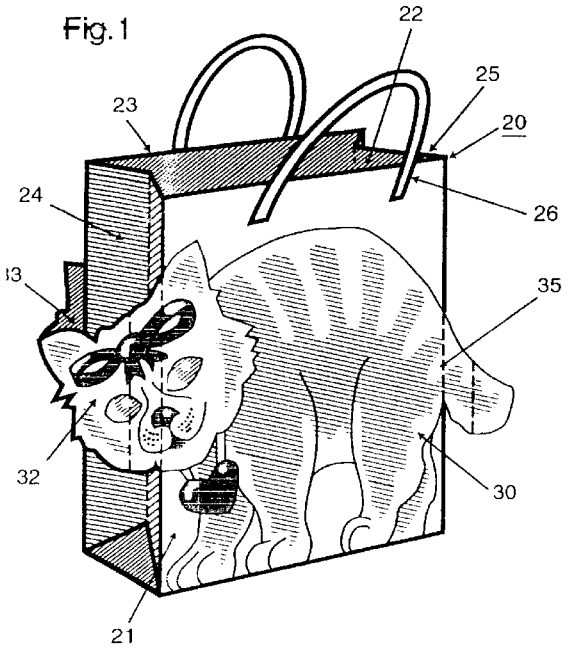
FIG. 1 is a front perspective view of one embodiment of the decorative, visually stimulating and display article holding system of the present invention depicted in its fully opened position.
Figure 2:
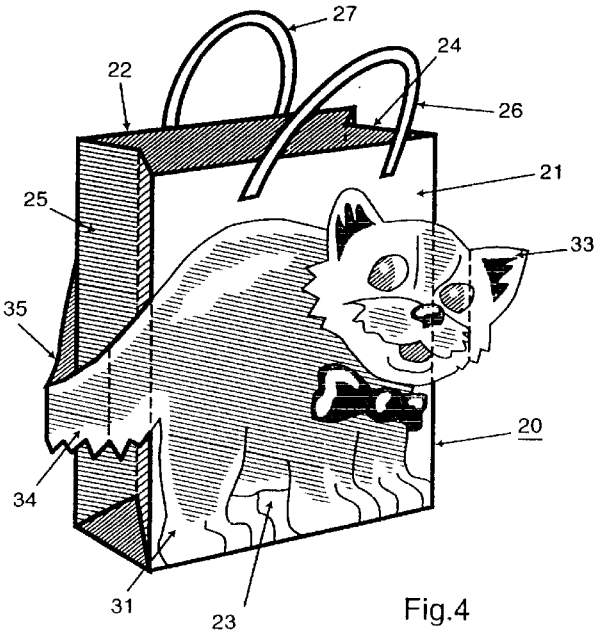
FIG. 2 is a rear perspective view of the fully opened system of FIG. 1.
Figure 3:
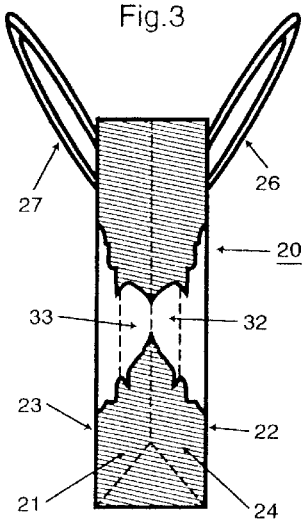
FIG. 3 is a side elevation view of the system of FIG. 1.
Figure 4:
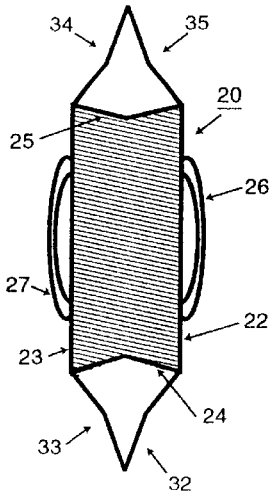
FIG. 4 is a top plan view of the system of FIG. 1.

As depicted in FIGS. 1 and 2, article holding system 20 is constructed with a visually distinctive, exciting, and interest-generating visual image associated with both front panel 22 and rear panel 23 thereof. In order to attain this visually distinctive, interesting and exciting impression, indicia 30 is formed on front panel 22, while indicia 31 is formed on rear panel 23.

Indicia 30 and 31 may comprise any desired visual image, representing any desired subject matter. For exemplary purposes, indicia 30 is depicted as representing the body of a cat, while indicia 31 is also depicted as a visually different cat. As is apparent from FIGS. 1 and 2, indicia 30 and 31 comprise a substantial portion of the panel upon which the indicia appear, depicting a substantial portion of the body of the cat. However, the cat is not depicted in its entirety on either panel 22 or 23.

In order to provide the exciting, visually enhanced article holding system 20 of the present invention, system 20 incorporates cooperating flap members 32 and 33 extending from side panel 24. Similarly, flap members 34 and 35 are mounted for extending cooperative interengagement with side panel 25.

As clearly shown in FIGS. 1 and 2, flap members 32, 33, 34 and 35 are each constructed for visually cooperating with the indicia directly adjacent the mounting zone of each flap with article holding receptacle 21. In this regard, flap member 32 comprises a substantial portion of the head of the cat depicted as the image representing indicia 30 on panel 22. As a result of this construction, flap portion 32, as it extends from the side edge of front panel 22, presents a visual impression of the cat depicted on panel 22 as physically extending beyond the terminating edge of panel 22. In this way, the visual impression is created which simulates a cat standing in front of article holding receptacle 21.

This visual impression is further enhanced by flap member 35, which extends from side panel 25, directly adjacent the rear of cat indicia 30 on panel 22. As depicted, flap 35 incorporates the visual representation of the tail of the cat, thereby presenting the visual impression that the tail of the cat extends beyond the side edge of panel 22.

In FIG. 2, the cat depicted on panel 23 as indicia 31 also presents a substantially similar visual impression, with flap member 33 extending beyond the side edge of panel 23 and incorporating the remainder of the head of the cat depicted on panel 23. In this way, the visual impression of the head of the cat extending beyond panel 23 is attained. Similarly, flap member 34 comprises a depiction of the tail of the cat shown as indicia 31 on panel 23, providing the visual impression that the tail of the cat extends beyond the side edge of panel 23.

As is apparent from FIGS. 1 and 2, taken in conjunction with the foregoing detailed disclosure, the incorporation of flap members 32, 33, 34, and 35 with article holding receptacle 21, constructed as detailed above, establishes an article holding system 20 which provides a visually distinctive, interesting and exciting impression, heretofore unattainable with prior art article holding receptacles. By incorporating the flap members along the side edges of article holding receptacle 21, with each flap member visually constructed with indicia thereon coordinated with the indicia appearing on the panel with which the flap member is associated, an overall, unique, visual impression is produced, and the resulting article holding system attains a totally new dimension previously unrealized and unattainable with prior art systems. As a result, a highly unique, distinctive, visually exciting article holding system 20 is realized.

Although flaps 32, 33, 34, and 35 can be mounted to article holding receptacle 21 in a plurality of alternate ways, the most efficient, and least expensive, is to either form flap members 32 and 33 from a single piece of material or to construct flap members 32 and 33 independently and affix the flap members to each other along the adjacent cooperating edges thereof. In this way, a generally V-shaped construction is realized.

In order to affix the V-shaped construction of flap members 32 and 33 to article holding receptacle 21, the terminating edge of each of the flap members is folded and fastened, typically by adhesive means, to side panel 24. This construction is best seen in FIG. 1.

Using a similar construction, flap members 34 and 35 are formed either from a single sheet of material or are affixed to each other to form a V-shaped component, as detailed above. In addition, in order to securely mount flap members 34 and 35 to article holding receptacle 21 in the desired manner, the terminating edges of the V-shaped cooperating flap members are independently folded, with the folded portion affixed to side panel 25, as shown in FIG. 2. In this way, flap members 32–33, and 34–35 are all easily mounted to the desired panel member, positioned in the precisely desired location for providing the enhanced visual display.

As shown in FIG. 5, flap members 32–33 and 34–35 are preferably constructed for ease of folding whenever article holding receptacle 21 is to be folded along side panels 24 and 25. In the embodiment depicted, the integrated V-shaped flap portions formed by flaps 32–33 and 34–35 are constructed to fold with side panels 24 and 25 with a major portion of the flap members being folded over front panel 22. In this way, ease of storage of article holding system 20 is attained and, whenever desired, article holding system 20 can be quickly and easily opened to provide the enhanced visual display inherent therewith. If desired, flaps 32—32 and 34–35 may be constructed, as detailed below, in a manner which enables flaps 32–33 and 34–35 to be folded within side panels 24 and 25. In this way, a more compact, completely folded assembly is attained.

Figure 6:
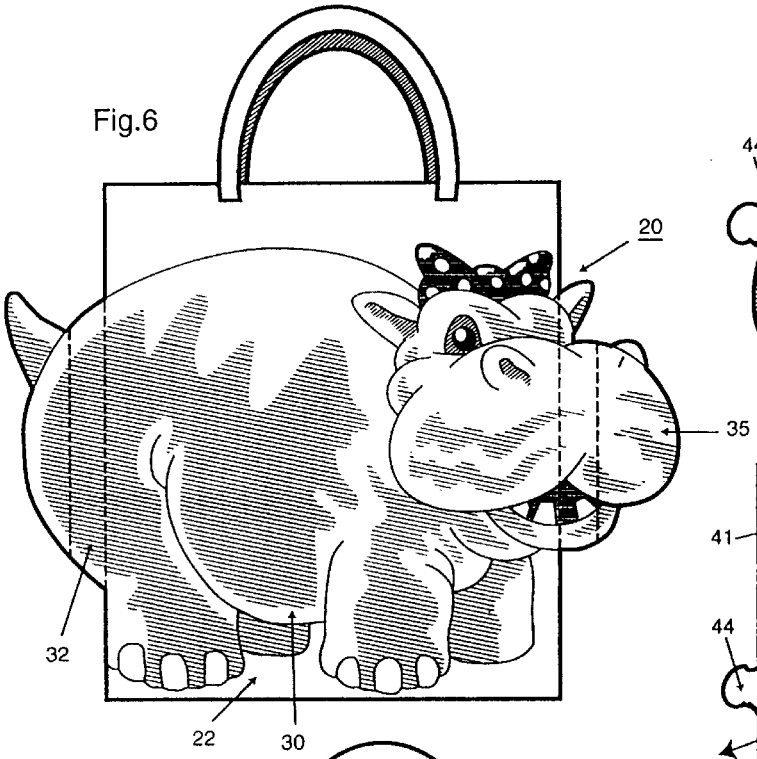
FIGS. 6 and 7 are front elevational views of the system construction of FIG. 1 depicting alternate visual indicia employed in association with the system.
Figure 7:
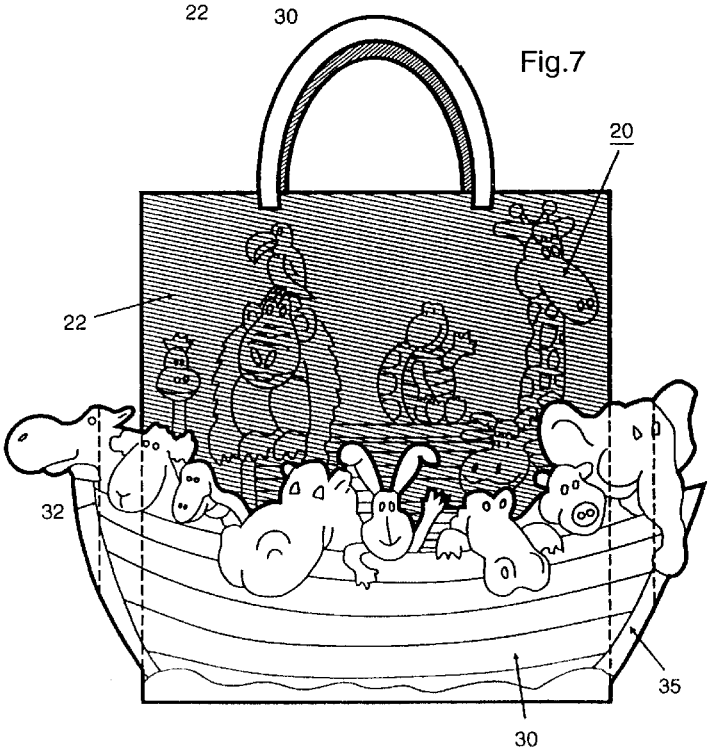

In FIGS. 6 and 7, two alternate embodiments of article holding system 20 are depicted. In these embodiments, front panels 22 are depicted with indicia 30 formed thereon comprising substantially different representations of alternate subject matters. However, in each embodiment, flap members 32 and 35 are mounted in association with front panel 22 to provide the desired distinctive, visually exciting display attained by the unique article holding system 20 of the present invention.

In FIGS. 28 and 29, a further alternate embodiment of the invention is depicted. In this embodiment, article holding system 20 incorporates a generally conventionally constructed article holding receptacle 21 with flaps 32–33 affixed to side panel 24 of article holding receptacle 21 and flaps 34–35 affixed to side panel 25 of article holding receptacle 21.

In this embodiment, no cooperating, visual indicia are printed on front panel 22 or rear panel 23. Instead, flap members 32–33 and 34–35 are employed to provide the desired enhanced, exciting visual impression.

As shown in FIG. 29, in this embodiment, flaps 32–33 and 34–35 are constructed with integrally formed fold lines incorporated therein in order to enable flaps 32–33 and 34–35 to be easily and conveniently folded and fully stowed within side flaps 24 and 25, whenever storage of article holding receptacle 21 is desired. In this way, compact, fully stowed flap members are provided which are quickly and easily fully extended from their stowed position to their fully displayed position whenever the enhanced, exciting and stimulating visual impression is desired.

Figure 8:
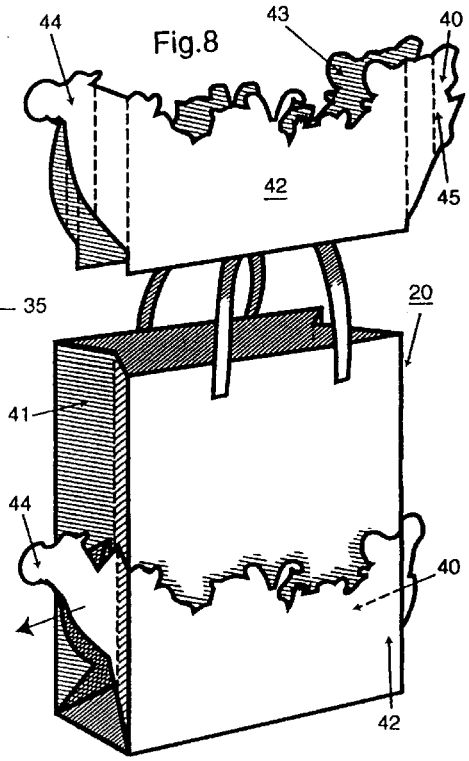
FIG. 8 is an exploded front perspective view of an alternate embodiment of the display and article holding system of the present invention depicting a dual component construction for forming the display and article holding system.
Figure 18:
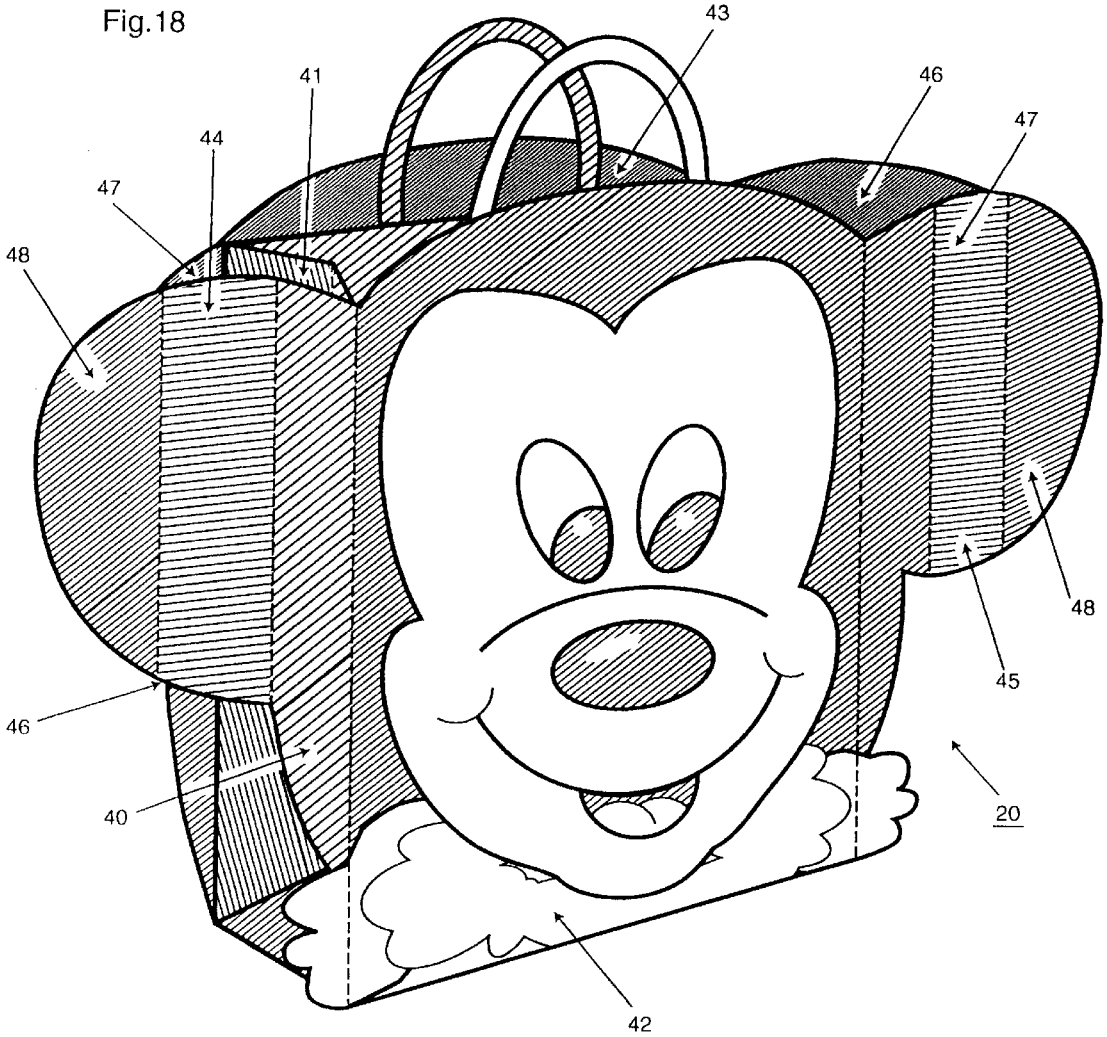
FIG. 18 is a front perspective view of an alternate embodiment of the article holding system of the present invention depicting an enlarged overlay assembly mounted to a generally conventional system construction to form an article holding system having a dual component construction.
Figure 19:
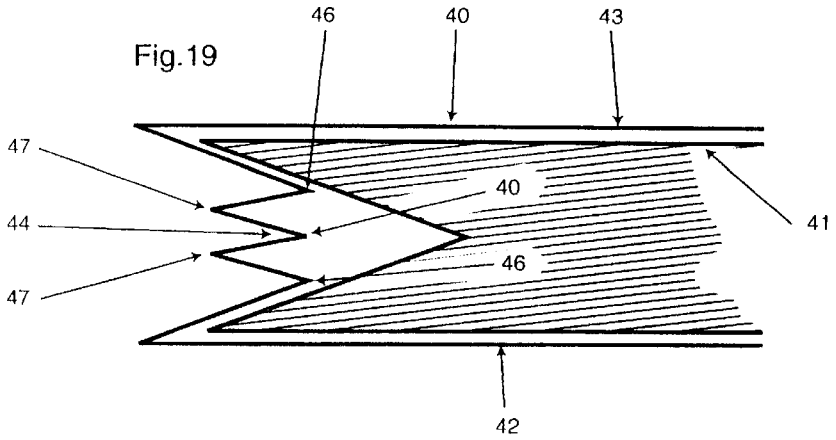
FIG. 19 is a diagrammatic top plan view, partially broken away, showing the stowability of the side flaps of the overlay of FIG. 18 within the side panels of the article holding receptacle associated therewith.

In FIGS. 8, 18, and 19 a further alternate embodiment of the present invention is shown. In this embodiment, the desired visually distinctive, exciting and interest-generating visual image attained by the embodiments detailed above, is achieved using an alternate construction. In this embodiment, visually distinctive article holding system 20 is formed by employing overlay assembly 40 in combination with a generally conventional article holding receptacle 41, which is constructed in the typical, prior art manner. If desired, in employing this embodiment of the present invention, virtually any conventional article holding receptacle 41 may be used.

In this embodiment, the desired visually distinctive, exciting and interest-generating visual image is provided by overlay assembly 40. In its preferred construction, overlay assembly 40 incorporates any desired indicia printed on the outer surface of overlay assembly 40 in order to provide the precisely desired visual impression for presentation to the recipient of article holding system 20. Although overlay assembly 40 is depicted in FIG. 8 without any indicia, any desired indicia may be employed, including the indicia detailed above and depicted in FIGS. 1–7.

In the construction of this embodiment, overlay assembly 40 incorporates a front panel 42, a rear panel 43, and extendable side panels 44 and 45 integrally connected with front panel 42 and rear panel 43. As clearly depicted in FIGS. 8, 18, and 19, extendable side panels 44 and 45 are constructed with integrally formed fold lines formed therewith for enabling side panels 44 and 45 to be either folded integrally with or extended away from front panel 42 and rear panel 43.

In addition to printing indicia on front panel 42 and rear panel 43, cooperating indicia is also printed on extendable side panels 44 and 45. In this way, overlay assembly 40 comprises a visual presentation of a particularly desired subject matter which is substantially equivalent to the visual impression attained by the article holding system constructions detailed above in FIGS. 1–7.

In order to attain this equivalent, visually distinctive, exciting and interest-generating visual impression, extendable side panels 44 and 45 incorporate indicia printed thereon which is complementary to and coordinated with the indicia printed on front panel 42 and rear panel 43. Once overlay assembly 40 is mounted to article holding receptacle 41, as detailed below, side panels 44 and 45 are easily unfolded and extended, when article holding receptacle 41 is open, thereby producing the visual impression that the particular indicia depicted thereon extends beyond the dimensions of article holding receptacle 41. In this way, the unique, visually distinctive, exciting and enhanced article holding system is attained in a manner which is achieved with substantial flexibility and ease.

In FIGS. 18 and 19, this embodiment of the present invention is depicted as a substantially enlarged, visually distinctive overlay which is constructed for covering the front and rear panels of article holding receptacle 41 substantially in its entirety. Due to its substantial size, foldable side panels 44 and 45 are also constructed substantially larger than the panels depicted in FIG. 8. For purposes of illustration, overlay assembly 40 is depicted as a caricature of a mouse appearing on both the front and rear panels thereof.

As clearly shown in FIGS. 18 and 19, side panels 44 and 45 are substantially larger than side panels 44 and 45 of overlay 40 of FIG. 8. As a result, an alternate folding system is required in order to assure that side panels 44 and 45 conveniently and easily fold into the foldable side portion of article holding receptacle 41. In order to enable panels 44 and 45 of overlay assembly 40 of FIG. 18 to attain the desired characteristics, both the front portion and rear portion of side panel 44 incorporates preformed creased edges or fold lines 46 and 47 on each surface thereof with the front and rear surfaces being joined along fold line 48.

In this way, as clearly depicted in FIG. 19, side panel 44 easily folds in an accordion-type manner whenever storage of panel 44 and folded article holding system 41 is desired. In the preferred embodiment, in order to attain the desired enlarged side panels 44 and 45 of FIG. 18, foldable edge 48 reverses direction between its fully extended position and its completely folded position. By constructing side panels 44 and 45 in this manner with mating edge 48 constructed to reverse direction upon display and folding, the desired accordion folding of side panels 44 and 45 is easily achieved and a uniquely constructed, visually distinctive, exciting and interest generating overlay assembly 40 is realized with side panels being substantially enlarged when fully extended for added visual benefit and enhanced excitement.

By employing this embodiment of the present invention, any desired article holding receptacle 41 can be employed with virtually any desired overlay assembly 40. In order to produce the desired visually distinctive article holding system 20 of this invention, overlay assembly 40 is placed about the outer surface of article holding receptacle 41, with front panel 42 of overlay assembly 40 affixed to the front panel of article holding receptacle 41, and with rear panel 43 of overlay assembly 40 being affixed to the rear panel of article holding receptacle 41. Once affixed in position, either by adding adhesive means or by employing adhesive means incorporated on the interior surface of panels 42 and 43, overlay assembly 40 is securely mounted to article holding receptacle 41. This results in the desired, unique, distinctive, and interest-generating article holding system 20.

By forming side panels 44 and 45 with fold lines incorporated therein, so as to enable side panels 44 and 45 to be foldable or extendable from the side panel of article holding receptacle 41, this embodiment of article holding system 20 is easily folded for storage, even after overlay assembly 40 has been affixed to article holding receptacle 41. If storage is desired, article holding system 41 would be folded in its normal manner, with side panels 44 and 45 folded along their pre-formed fold lines for cooperative, interengaged folding with article holding receptacle 41.

In addition, whenever article holding system 20 is to be employed, article holding receptacle 41 is unfolded, in the conventional manner, and extendable side panels 44 and 45 are outwardly extended from article holding system 41, in order to attain the precisely desired, visually distinctive, exciting, and interest-generating impression provided by article holding system 20.

By employing this embodiment of the present invention, inherent flexibility and variety is attained. As opposed to constructing entire holding systems in the manner detailed above in reference to FIGS. 1–7, overlay assemblies 40 can be constructed with a wide variety of shapes, sizes, and indicia printed thereon. In this way, a consumer is able to select from a wide variety of different overlay assemblies, each having different indicia, patterns, forms, and subject matter, and is able to select one that precisely fits the desired impression sought by the consumer. In addition, overlay assembly 40 can be employed with virtually any desired article holding receptacle 41 for affixation thereto. In this way, an otherwise conventional article holding receptacle 41 is quickly and easily converted into a unique, visually distinctive, article holding system 20, providing a visual impression particularly suited to the precise event being celebrated.

In FIGS. 9–14, different constructions of an alternate embodiment of article holding system 20 of the present invention are depicted. In each of these embodiments, article holding system 20 is formed from article holding receptacle 51, which incorporates front panel 52, rear panel 53, and side panels 54 and 55. As with the previous embodiment, article holding receptacle 51 is formed in a generally conventional manner, with front panel 52, rear panel 53 and side panels 54 and 55 all integrally connected to each other to form the desired article holding receptacle. In addition, side panels 54 and 55 are constructed with preformed fold lines incorporated therein in order to enable article holding receptacle 51 to be folded, when desired.

In this embodiment, the unique, distinctive, festive atmosphere and visual impression is promoted by effectively incorporating greeting card type messages or displays onto article holding system 20. In attaining this goal, front panel 52 of article holding system 20 incorporates a cut-out or open zone 58. In addition, article holding system 20 also incorporates a panel 59 movably mounted to front panel 52 of article holding system 20, and cooperatively associated with cut-out zone 58.

Figure 9:
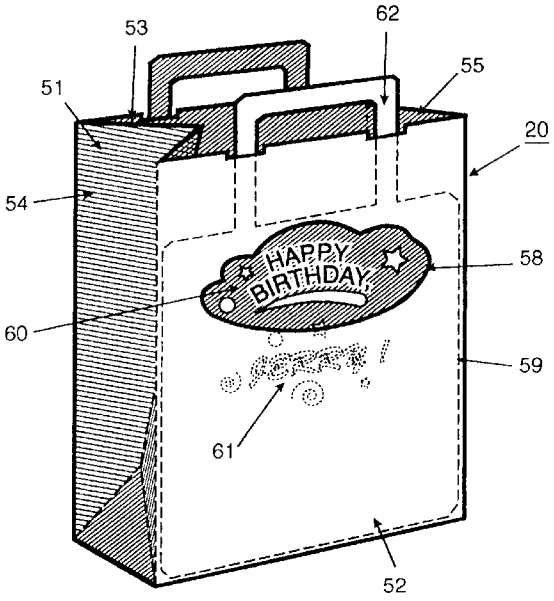
FIGS. 9 and 10 are front perspective views of a further alternate embodiment of the visually stimulating display and article holding system of the present invention.
Figure 10:
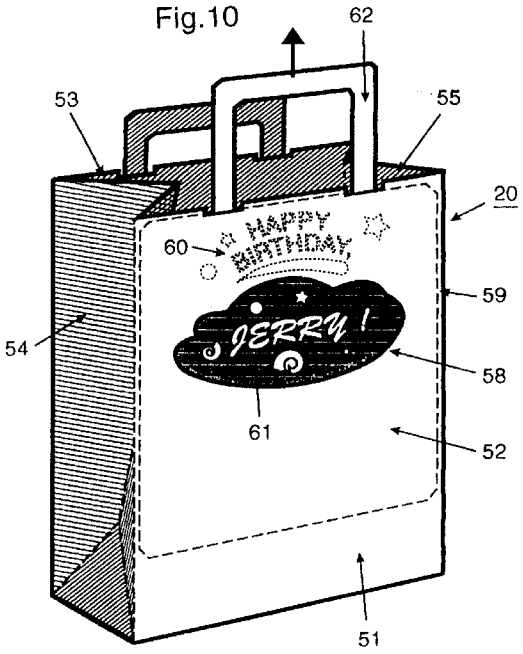

In the embodiment depicted in FIG. 9 and 10, indicia 60 and 61 are pre-printed on movable panel 59 in spaced relationship to enable only one of the indicia to be visible through cut-out zone 58 at one time. In this way, by alternately raising and lowering movable panel 59 relative to cut-out zone 58, either indicia 60 or indicia 61 is visible through cut-out or open zone 58.

As depicted in FIGS. 9 and 10, for exemplary purposes only, indicia 60 comprises an alphanumeric message "HAPPY BIRTHDAY", while indicia 61 comprises the alphanumeric message "JERRY!". Typically, article holding system 20 would be presented to a recipient with movable panel 59 in its lowermost position, as depicted in FIG. 9, visually displaying the message "HAPPY BIRTHDAY" through cut-out or open zone 58. By raising movable panel 59 to its upward position, the indicia appearing through cut-out zone 58 changes, displaying the recipient's name "JERRY" therein. In this way, a personalized article holding system 20 is attained which is capable of providing to the recipient added excitement and enjoyment.

In the preferred embodiment, movable panel 59 incorporates a handle 62 which is either affixed to panel 59 or integrally formed therewith. By employing handle 62, panel 59 is easily moved between its two alternate positions relative to cut-out zone 58.

In the preferred construction of this embodiment, front panel 52 of article holding system 20 is constructed with two separate and independent cooperating wall members, with the inside or interior wall member extending below the lowermost position of panel 59. In this way, movable panel 59 is peripherally surrounded and substantially enclosed within the material used for forming article holding system 20.

In the preferred construction, the two wall members forming front panel 22 are integrally connected or securely affixed to each other along their top edges. In this way, panel 59 is securely captured within front panel 52, with handle member 62 being required to raise and lower panel member 59.

In order to further enhance the unique visually appealing, decorative, and exciting impression provided by article holding system 20 of the present invention, rear panel 53 of article holding system 20 is preferably constructed in a manner similar to panel 52, incorporating therein movable panel 64. However, in order to heighten the visual distinctiveness and enjoyability of this embodiment of article holding system 20, the indicia printed on rear panel 23 and movable panel 64 are completely different from the indicia appearing on front panel 52.

Preferably, the indicia employed on panels 52 and 53 are preferably complementary and further heighten the particular event or occasion being celebrated. In order to add further interest and excitement, in this embodiment, rear panel 53 incorporates indicia 65 printed thereon in addition to incorporating cut-out zones 66. As detailed herein, indicia 65 appearing on panel 53 is constructed to be complementary to and coordinate with the indicia printed on movable panel 64.

Figure 11:
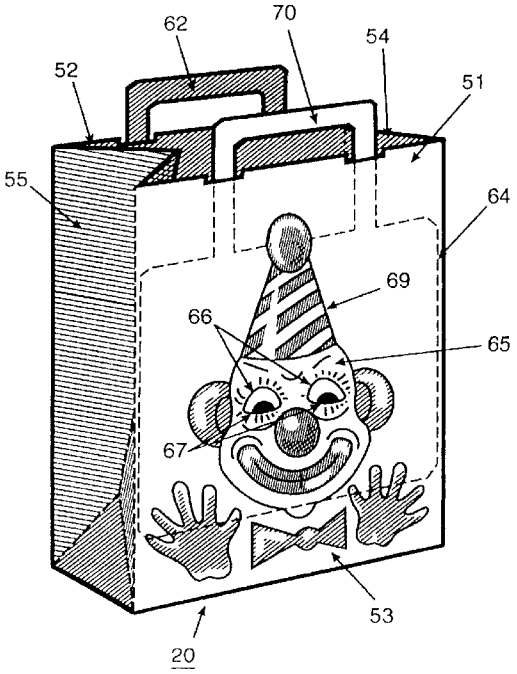
FIGS. 11 and 12 are rear perspective views of the display and article holding system of FIGS. 9 and 10.
Figure 12:
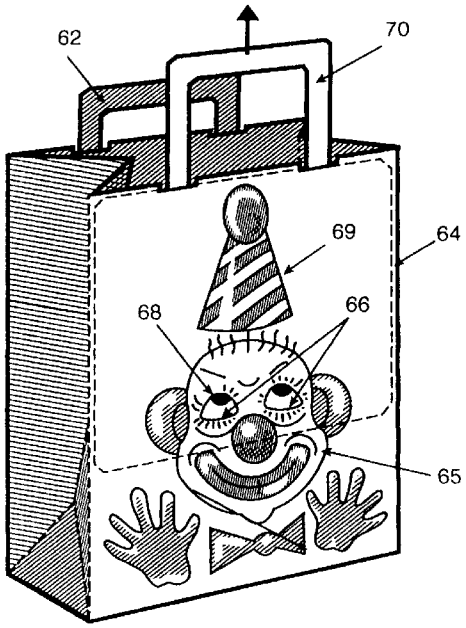

As shown in FIGS. 11 and 12, for exemplary purposes only, indicia 65 printed on rear panel 53 comprises a cartoon representation of a clown. In addition, cut-out zones 66 formed in rear panel 53 are positioned to represent the eyes of the clown formed by indicia 65.

In order to show the versatility and variability of this invention, this embodiment is depicted with movable panel 64 incorporating indicia 67 and 68 printed thereon in relationship to cut-out zone 66 for alternate, cooperative, visible relationship therewith, depending upon the position of panel 64. In addition, movable panel 64 also incorporates independent member 69 which is attached to panel 64 and is continuously visible while also being movable with panel 64. As depicted, member 69 is affixed to panel 64 and extends through rear panel 53, with a major portion of independent member 69 remaining visible regardless of the position of panel 64.

In the embodiment, as depicted in FIGS. 11 and 12, independent movable member 69 is shown as a party hat, positioned in cooperating relationship with the clown represented by indicia 65 of panel 53. In its lowermost position, as depicted in FIG. 11, member 69 covers a portion of the clown's head. By moving panel 64 from its lowermost position to its uppermost position, the hat, formed by independent member 69 moves from its head covering position to a head-removed, raised position, as depicted in FIG. 12.

In addition, indicia 67 represents the eyes of the clown of indicia 65 which are in a first lower position when panel 64 is in its lowermost position, as depicted in FIG. 11. However, when panel member 64 is moved to its fully raised position, indicia 68 cooperate with cut-out zone 66 to present the eyes of the clown in a fully upward position, as shown in FIG. 12.

As detailed above, panel member 64 is preferably constructed with handle 70, which is either integrally formed with or connected to panel 64 for enabling panel 64 to be easily moved between its two alternate positions. In addition, using the construction detailed above, panel member 64 and handle 70 are preferably mounted within a dual-wall construction in order to assure that panel member 64 is securely, captively, retained within a closed zone for assuring its continued trouble-free operation.

Although this embodiment of article holding system 20 is depicted with both front panel 52 and rear panel 53 incorporating complementary indicia and movable panels, alternate constructions may be employed without departing from the scope of this invention. Clearly, article holding systems consistent with this disclosure, can be constructed with only a single panel incorporating indicia and/or cut-out zones associated therewith, with alternate means being employed for raising and lowering any movable panel member. In addition, any desired indicia can be employed, with the indicia either being pre-printed on the panels of the article holding system or, alternatively, constructed for having the user place any desired message, drawing, figure, etc. on the movable panel in order to personalize the display.

Figure 13:
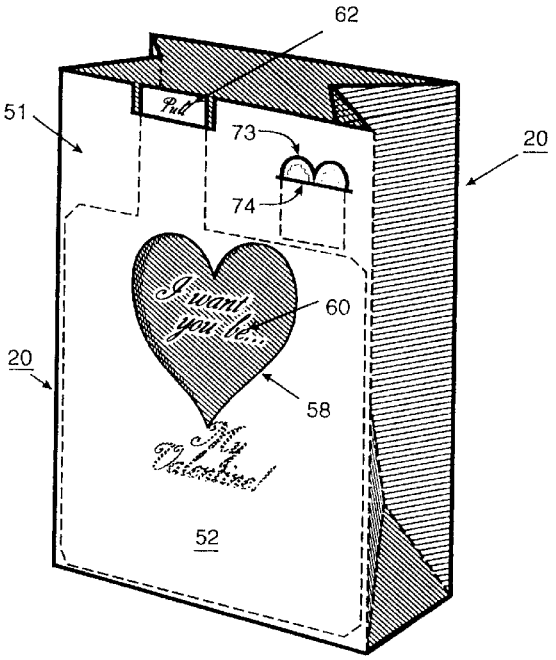
FIGS. 13 and 14 are front perspective views of still further alternate embodiments of the decorative, visually stimulating display and article holding system of the present invention.
Figure 14:
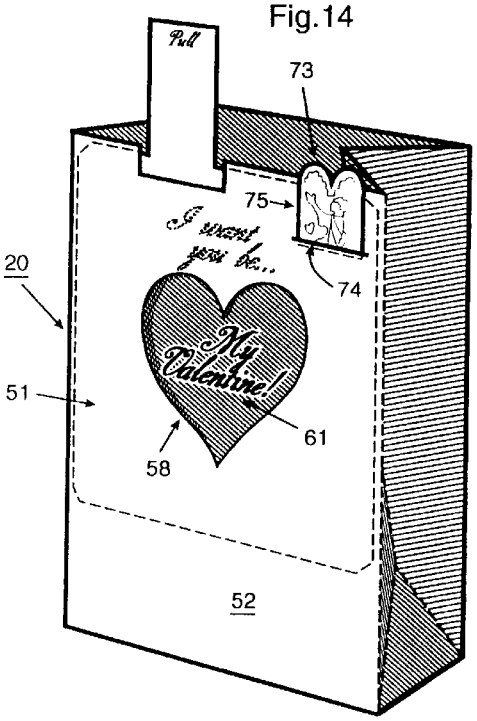

In FIGS. 13 and 14, one alternate construction for this embodiment of article holding system 20 is depicted. In this representation, article holding receptacle 51 is formed with front panel 52 incorporating a cut-out zone 58 which, in this embodiment, comprises a heart shape. In addition, indicia 60 comprises the alphanumeric message "WON'T YOU BE . . . " with indicia 61 comprising the alphanumeric message "MY VALENTINE!". By raising and lowering handle 62, integrally associated with panel 59 (not shown) on which the indicia is printed, indicia 60 and 61 is alternately displayed within cut-out zone 58. In this way, the desired Valentine's Day message is presented in a unique, and distinctive manner.

In order to further enhance the interest and excitement provided by article holding system 20, this embodiment also incorporates a secondary panel section 73 which protrudes from a slit 74, formed in panel 52, when handle 62, and the panel associated therewith, are in their lowermost position. As shown in FIG. 13, in this embodiment, exposed panel section 73 is shaped to form the top of a heart protruding from slit 74.

When handle 63 is moved to its uppermost position, panel section 73 is raised, exposing indicia 75 printed thereon. In this embodiment, indicia 75 comprises the visual representation of Cupid, to further enhance the Valentine's Day atmosphere for the gift recipient.

As is apparent from this disclosure of this additional embodiment of the present invention, the unique article holding system 20 of the present invention can be constructed in a variety of alternate ways without departing from the scope of this invention. Clearly, article holding systems may be constructed with any desired message or indicia associated therewith, with movable panels being constructed with a wide variety of indicia or movable members associated therewith.

In addition, movable panels can be formed on a single panel of the system or on any number of panels desired. As a result of the wide variety of alternate constructions that can be employed, it is apparent that the embodiments detailed above and shown in FIGS. 9–14 are presented merely as examples of the present invention and arc not intended, in any way, to limit the present invention to these particular embodiments.

Figure 15:
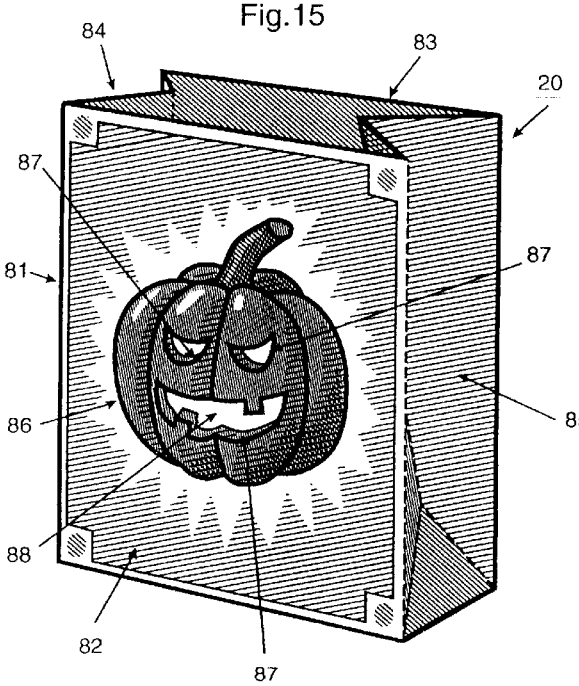
FIG. 15 is a front perspective view of a further alternate embodiment of the display and article holding system of the present invention.
Figure 16:
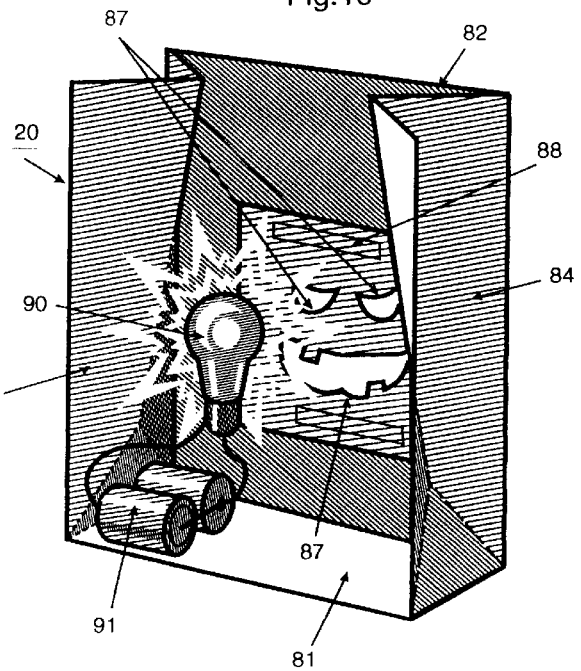
FIG. 16 is a rear perspective view of the display and article holding system of FIG. 15 with the rear panel removed, displaying the interior thereof.

In FIGS. 15 and 16, a still further alternate embodiment of the present invention is shown. In this embodiment, article holding system 20 is formed from article holding receptacle 81 having a generally conventional construction, incorporating front panel 82, rear panel 83, and side panels 84 and 85. In this embodiment, front panel 82 incorporates indicia 86 printed thereon and a plurality of cut-out zones 87 which are formed in front panel 82 cooperating with indicia 86.

As depicted in FIG. 16, in this embodiment, cut-out zones 87 are covered on the interior of front panel 82 by a translucent sheet of material 88 affixed to the inside surface of panel 82. In addition, illumination means 90 is mounted to the inside surface of translucent material 88, with illumination means 90 connected to a power source 91 in order to enable illumination means 90 to be illuminated, whenever desired. In this way, the light provided by illumination means 90 is diffused by translucent material 88, enabling a unique, visually distinctive appearance to be attained when indicia 86 is viewed with cut-out zones 87 glowing or being illuminated.

In the embodiment depicted in FIGS. 15 and 16, article holding system 20 is construction for use during Halloween, with indicia 86 comprising the visual representation of a pumpkin. In addition, cut-out zones 87 are formed to represent the eyes and mouth of pumpkin indicia 86.

When illumination means 90, in the form of a light bulb, is activated by power source 91, in the form of batteries, the eyes and mouth formed by cut-out zones 87 are brightly illuminated through the transparent material 88, providing article holding system 20 with a completely unique, visually distinctive appearance, particularly suited for the precise occasion being celebrated.

Figure 17:
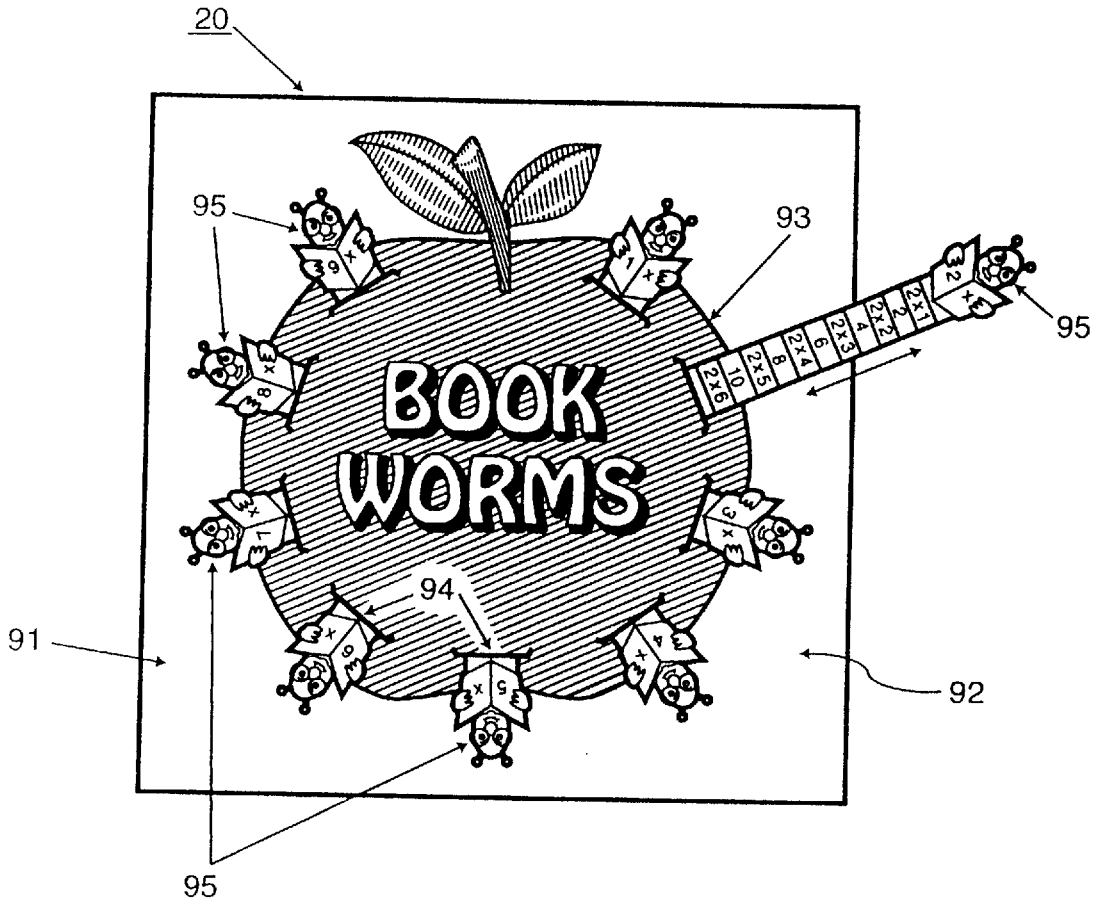
FIG. 17 is a front elevation view of a still further alternate embodiment of the display and article holding system of the present invention.

In FIG. 17, a still further alternate embodiment of article holding system 20 is depicted. In this embodiment, article holding system 20 incorporates article holding receptacle 91, which is formed in a generally conventional manner and comprises front panel 92. In this embodiment, front panel 92 of article holding receptacle 91 incorporates indicia 93 printed thereon and a plurality of slits or pockets 94 formed in front panel 92.

The construction of article holding system 20 of this embodiment is completed by incorporating a plurality of elongated, axially movable or extendable members 95 positioned in cooperating relationship with slits 94. Each member 95 is constructed for being movable relative to the particular slit 94 with which the movable member 95 is associated.

In the embodiment depicted in FIG. 17, indicia 93 comprises an apple, and movable members 95 are depicted as elongated worms, longitudinally movable relative to apple indicia 93 within slit 94. In order to provide added benefit to a consumer, this embodiment depicts elongated movable members 95 with indicia printed thereon which comprises math questions and answers.

By axially moving member 95 relative to slit 94, an individual is able to see a mathematical question and provide an answer before revealing the answer printed therebelow. In this way, an educational benefit is attained and article holding system 20 provides an added benefit in addition to its gift containing function.

Figure 20:
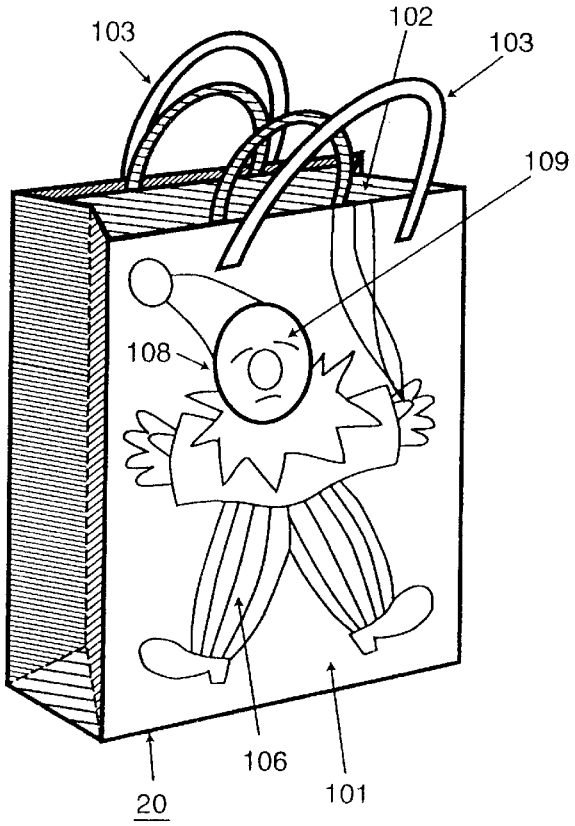
FIG. 20 is a front perspective view of a telescopically extendable article holding system manufactured in accordance with the present invention depicted in its unextended position.
Figure 21:
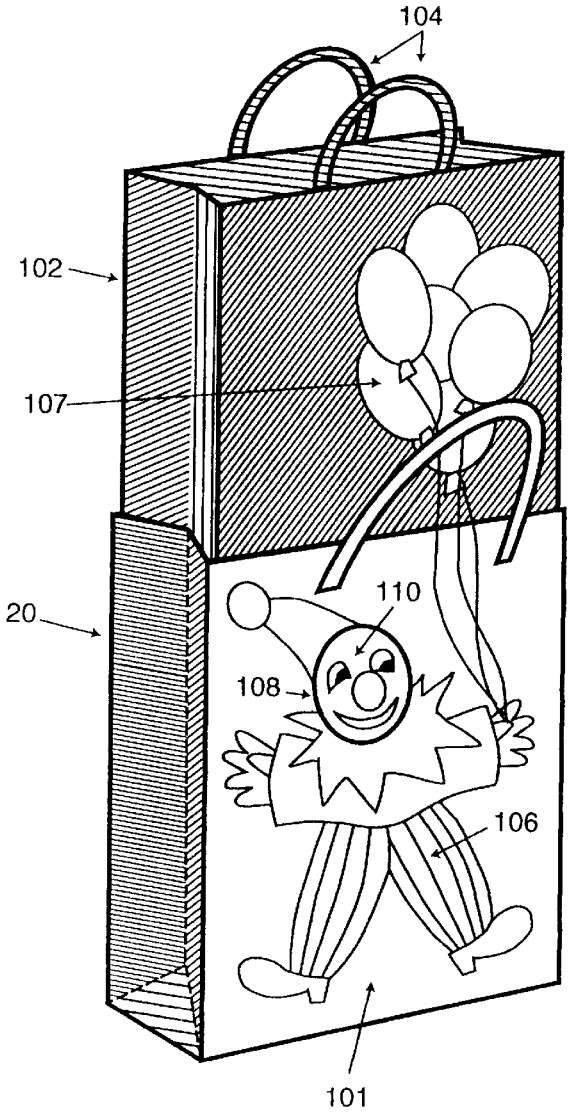
FIG. 21 is a front perspective view of the extendable article holding system of FIG. 20 depicted in its fully extended position.
Figure 22:
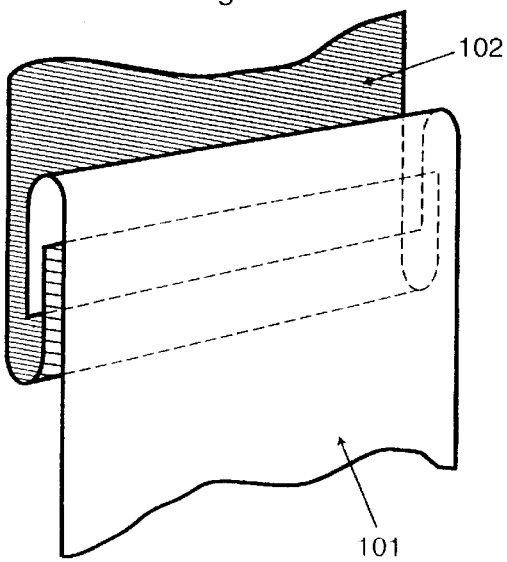
FIG. 22 is a perspective view, partially broken away, of the extendable article holding system of FIG. 21 depicting the locking mechanism incorporated therein.

In FIGS. 20–22, a further alternate embodiment of the present invention is fully detailed. In this embodiment, the desired visually distinctive, exciting and interest generating visual image is attained using at least two telescopically engaged article holding system components which are constructed for interlocked cooperating telescopic sliding engagement with each other, as well as cooperating to provide a unique visual display. In this embodiment, visually distinctive article holding system 20 comprises an outer article holding receptacle or system 101 and an inner cooperating sleeve member 102.

In the preferred embodiment, sleeve member 102 is formed with dimensions substantially equivalent to or slightly less than article holding system 101 in order to enable sleeve 102 to fit within article holding system 101 in direct, frictional, sliding cooperating interengagement with the inside surfaces of article holding system 101. If desired, two similarly constructed article holding systems can be employed for receptacle 101 and sleeve 102, with the bottom surface of sleeve 102 being cut out in order to enable access to the interior of article holding receptacle 101.

Furthermore, in the preferred embodiment, article holding receptacle 101 incorporates a pair of handles 103, 103 mounted in the conventional manner to the front and rear panels of article holding receptacle 101. Similarly, telescopically engaged sleeve 102 also incorporates a pair of handles 104, 104 mounted to its front and rear panels.

In the preferred construction, distinctive, exciting and interest generating visual image 106 is displayed on the front panel of article holding system or receptacle 101. In FIGS. 20 and 21, the distinctive, exciting and interest generating visual image 106 is depicted as a clown. In addition, the front panel of sleeve 102 also incorporates a distinctive, exciting and interest generating visual image 107 depicted thereon which, in this embodiment, comprises a plurality of balloons.

In the preferred construction, the visually distinctive image 107 displayed on sleeve 102 is formed to cooperate with and represent an extension of visual image 106 depicted on article holding receptacle 101. In this way, a unique, exciting, distinctive, interest generating article holding system 20 is attained.

By employing this embodiment, the user or recipient of article holding receptacle 101 visually enjoys decorative image 106 depicted thereon. In addition, this visual image is enhanced and expanded by telescopically moving sleeve 102 from its fully stowed position, within article holding receptacle 101, to its fully extended position, whereby image 107 of sleeve 102 is visually displayed, cooperating with image 106 to further enhance and expand the overall image presented to the consumer. This fully extended position is shown in FIG. 21.

By mounting sleeve 102 in telescopic interengagement with article holding receptacle 101, sleeve 102 is quickly and easily movable between its two alternate positions. By telescopically raising and lowering sleeve 102 relative to article holding system 101, a unique, exciting, distinctive and interest generating dual visual image is realized.

Furthermore, if desired, the front panel of article holding system 101 may also incorporate a cut-out zone 108, forming a part of visual image 106. In the embodiment depicted in FIGS. 20 and 21, cut-out zone 108 is formed on the front panel of article holding system 101 in the area defining the face of the clown.

In addition, in order to provide cut-out zone 108 with visual information, a cooperating visual display 109 is formed on sleeve 102, positioned in juxtaposed, spaced, cooperating relationship with cut-out zone 108. In this way, as shown in FIG. 20, the clown representing visual image 106 displays a sad face, as represented by cooperating visual display 109 formed on sleeve 102.

By incorporating a cut-out zone on the front panel of article holding receptacle 101, the visual information being displayed in the cut-out zone can be changed. As a result, when sleeve 102 is telescopically raised to its upper position, causing visual image 107 to be fully displayed, a second cooperating visual display 110 appears in cut-out zone 108, providing a totally different visual impression to image 106 of article holding receptacle 101.

As depicted in FIG. 21, the clown representing visual image 106 now displays a happy face, which is attained by visual display 110 formed on sleeve 102 which is positioned for being in juxtaposed, spaced, cooperating relationship with cut-out zone 108 when sleeve 102 is raised to its fully extended position. In this way, the unique, visually distinctive, exciting and interest generating article holding system 20 of the present invention is further enhanced.

In order to control the telescopic movement of sleeve 102 relative to article holding receptacle 101, while also assuring that sleeve 102 is not completely removed from article holding system 101, an interlocking system is employed between sleeve 102 and article holding receptacle 101. Although any desired interlock system can be employed without departing from the scope of the present invention, FIG. 22 depicts one interlocked system which has been found to provide the desired securement of sleeve 102 with article holding receptacle 101.

As shown in FIG. 22, one or more panels of article holding system 101 has a top edge which is folded over to form a generally inverted U-shaped configuration. Similarly, the bottom edge of the cooperating panel of sleeve 102 is also folded to form a U-shaped construction. By matingly engaging the folded portions of article holding system 101 and sleeve 102, the U-shaped portions of each respective surface matingly engage with each other, preventing movement beyond the position when the U-shaped portions are fully interlocked with each other. In this way, sleeve 102 is easily telescopically raised to the precisely desired, fully extended, position and is then locked in that position, preventing any further movement thereof.

If desired, all four panels of article holding receptacle 101 and sleeve 102 may be formed in this interlocking U-shaped manner in order to assure secure, locked, interengagement of sleeve 102 with article holding receptacle 101. Furthermore, as discussed above, any alternate locking system can be employed without departing from the scope of this invention.

If desired, instead of employing a single telescopically engaged sleeve 102 with article holding system 101, a plurality of telescopic sleeves can be cooperatingly associated with article holding system 101 in the manner detailed above, without departing from the scope of this invention. Furthermore, any desired visual image can be displayed on one or more surfaces of article holding receptacle 101 and sleeve 102 in accordance with this invention.

Although any desired image can appear and any surface on article holding receptacle 101 or sleeve 102 without departing from the scope of this invention, it is preferred that the visual image appearing on sleeve 102 be coordinated with and complementary to the visual image appearing on article holding receptacle 101. In this way, added benefit is attained by having an image which visually appears to grow or extend by moving sleeve 102 relative to article holding receptacle 101. In this way, the resulting visual image is more fully appreciated and the desired enhanced visual effect is realized.

In FIG. 23, a still further alternate embodiment of the present invention is shown. In this embodiment, visually distinctive article holding system 20 is constructed for cooperating association with a greeting or message bearing card. In its preferred construction, article holding system 20 incorporates an article holding receptacle 116, preferably having handles 117, 117, mounted to opposed panels, with at least one panel of article holding receptacle 116 also incorporating a greeting card holding and display assembly 118.

In the preferred construction, greeting card holding and display assembly 118 comprises a cut-out zone 120 formed in the desired panel of article holding receptacle 116, with cut-out zone 120 preferably being covered by transparent film 121, well known in the trade. If desired, transparent film 121 can be eliminated, however, the inclusion of film 121 is preferred in order to protect the surface of the card cooperatingly associated therewith.

In order to enable a user to attain access to cut-out zone 120 and transparent film 121, an elongated slit 122 is formed in the front panel of article holding receptacle 116 directly above cut-out zone 120. As shown in FIG. 23, elongated slit 122 is constructed with an overall length greater than the conventional width of a typical greeting card. In this way, as depicted in FIG. 23, a conventional greeting or message bearing card 123 can be easily inserted through elongated slit 122 in order to enable the front panel of greeting card 123 to be displayed through cut-out zone 120 and transparent film 121.

In order to complete the construction of card holding and display assembly 118, a pouch forming wall member 124 is affixed to the inside surface of the front panel of article holding receptacle 116 in juxtaposed, spaced relationship with cut-out zone 120. In the preferred embodiment, pouch forming wall member 124 is formed larger than cut-out zone 120 and is affixed, by adhesive means, about its outer peripheral edge directly to the inside surface of the front panel of article holding receptacle 116. In this preferred construction, the top edge of pouch forming wall member 124 is affixed above elongated slit 122.

By employing this construction, a card holding zone is created between pouch forming wall member 124 and the combination of cut-out zone 120 and transparent film 121. The entry to the holding zone is provided by elongated slit 122. As a result of this construction, any desired message bearing card 123 can be easily inserted in card holding and display assembly 118, enabling the top surface of the message bearing card 123 to be easily readable through cutout zone 120 and transparent film 121.

By employing this embodiment of the present invention, a visually distinctive article holding system 20 is attained which can be employed for holding a gift for any desired occasion. By merely purchasing a message bearing card directly related to the purpose for which the gift is being given, the desired card can be inserted in card holding and display assembly 118 of article holding receptacle 116. In this way, a visually distinctive article holding system 20 is attained quickly and easily, which is usable precisely for a desired gift giving purpose. In addition, whenever the recipient of visually distinctive article holding system 20 desires to read message bearing card 123 in its entirety, card 123 can be easily removed from article holding receptacle 116 and enjoyed in its entirety.

In FIGS. 24 and 25, a further alternate embodiment of the present invention is depicted. This embodiment is similar in purpose and function to the embodiment detailed above in reference to FIG. 23, providing an alternate construction for attaining a combined message delivery card and article holding receptacle.

In this embodiment, visually distinctive article holding system 20 comprises article holding receptacle 128, preferably incorporating carrying handles 129, 129 affixed to the front and rear panels thereof. In addition, a cut-out zone 130 is formed in the front panel of article holding receptacle 128, effectively forming a portal in the front panel of article holding receptacle 128. In its preferred construction, tab portion 131 is formed along one side edge of cut-out zone 130 extending inwardly into the portal formed by cut-out zone 130.

In this embodiment, message bearing or visually distinctive indicia bearing card 132 is secured to a mounting panel 133. Cut-out zone 130 is dimensioned to correspond to the dimensions of conventional message bearing card 132 with mounting panel 133 being substantially larger than portal 130.

In this embodiment, any desired indicia or message bearing card 132 is quickly and easily associated with article holding receptacle 128 by securely affixing card 132 to panel 133. Then, card 132 is positioned in cut-out zone 130 and mounting panel 133 is affixed to the inside surface of the front panel of article holding receptacle 128. For this purpose, any adhesive means can be employed or, alternatively, card support panel 133 can be formed with a layer of adhesive means affixed thereto which is protected by a release liner. By employing this construction, the user merely removes the release liner and quickly and easily mounts card 132 to panel 133 and then affixes panel 133 to the inside surface of the front panel of article holding receptacle 128. In this way, card 132 is positioned in the precisely desired location in cut-out zone 130 quickly and easily, providing a visually distinctive, personalized system 20.

Once card 132 has been securely affixed within cut-out zone 130, tab 133 retains the front panel of card 132, assuring that the front panel of card 132 is continuously visually displayed. In addition, whenever the recipient wishes to read the card in its entirety, a front panel of card 132 can be easily pivoted out of holding engagement with tab 131, thereby enabling the recipient to read the entire message on the card.

As with the embodiment detailed above in reference to FIG. 23, this embodiment of the present invention enables any desired greeting card to be combined with article holding receptacle 128 in order to achieve a unique, specially designed, visually distinctive article holding system 20. By employing this embodiment or the embodiment of FIG. 23, the gift giver is able to personalize both the message bearing card and any indicia that may appear on the article holding receptacle 116 and 128 in order to assure color coordination, similar images, indicia, or messages. As a result, a more personalized, visually distinctive and interest generating article holding system 20 is realized.

Figure 26:
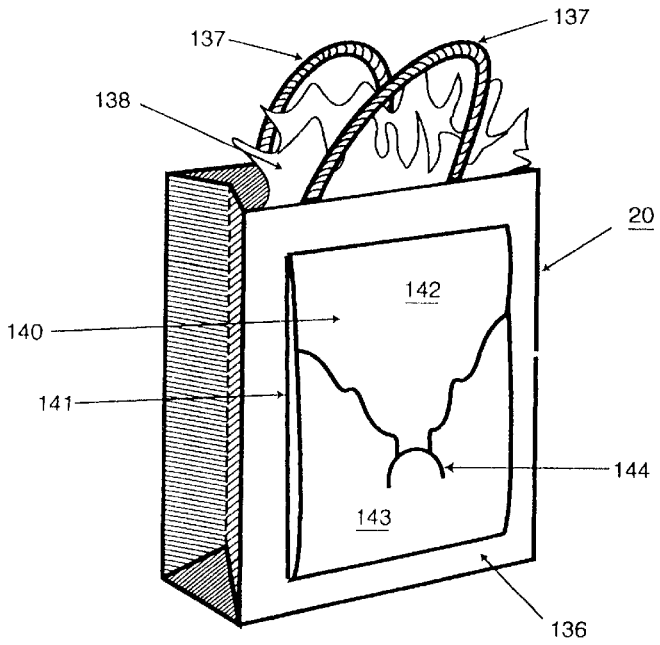
FIG. 26 is a front perspective view of a still further alternate embodiment of the article holding system of the present invention depicted with a greeting or message bearing card assembly integrally formed therewith, shown with the card in its closed position.
Figure 27:
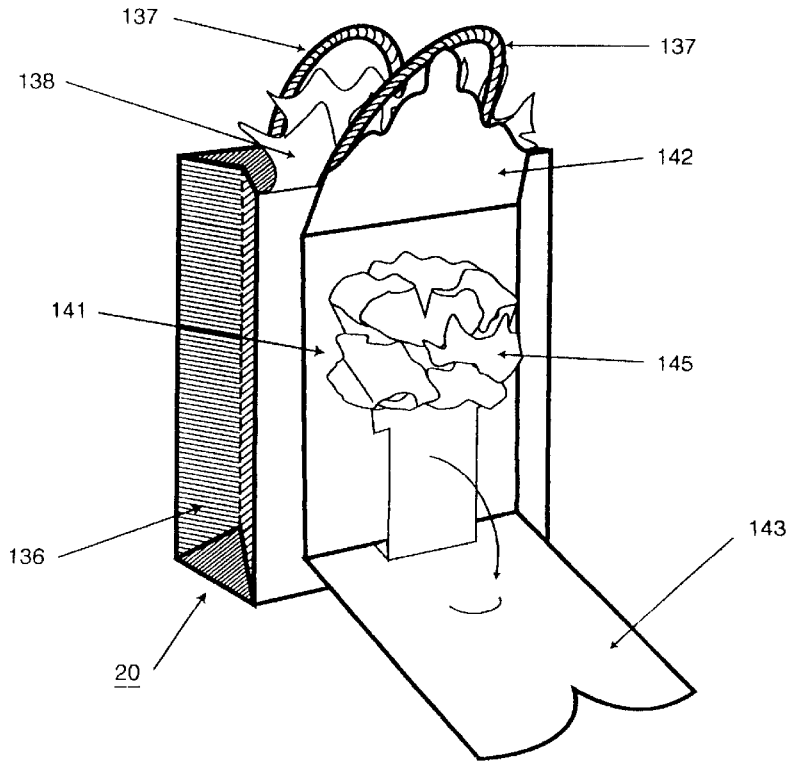
FIG. 27 is a front perspective view of the article holding system of FIG. 26 depicted with the card assembly in its open position.

In FIGS. 26 and 27, another alternate embodiment of the present invention is depicted. In this embodiment, visually distinctive article holding system 20 comprises an article holding receptacle 136 preferably in the form of a small or mini-bag typically employed with small gifts, such as jewelry. Typically article holding receptacle 136 incorporates handles 137, 137 and decorative paper insert 138.

In order to provide article holding receptacle 136 with a visually distinctive, exciting and interest generating visual image, card assembly 140 is integrally formed on one panel of article holding receptacle 136. In the preferred embodiment, as depicted in FIGS. 26 and 27, card assembly 140 comprises a central panel 141 which is affixed to the desired panel of article holding system 136 in a manner which securely mounts panel 141 to the panel of article holding receptacle 136.

The construction of card assembly 140 is completely by incorporating movable panel 142, which is affixed to the top edge of central panel 141, and movable panel 143, which is affixed to the bottom edge of central panel 141. Movable panels 142 and 143 are preferably constructed to be pivotally movable in opposite arcuate directions relative to central panel 141.

In this embodiment, the construction of card assembly 140 is completed by forming a tab receiving slit 144 in panel 143 which is dimensioned for receiving a cooperating edge of panel 142. In this way, the cooperating edge of panel 142 can be inserted within slot 144, retaining panels 142 and 143 in their closed position.

Whenever card assembly 140 is to be opened, to enable the recipient or user of visual distinctive article holding system 20 to use card assembly 140, panel 142 is pivoted upwardly, removing its end from engagement in slot 144. Then, panel 143 is arcuately pivoted downwardly, revealing the message contained on panel 141 and, if employed, the message on the inside surface of panel 143. As depicted in FIG. 27, panel 141 supports a three-dimensional fold-out or pop-out image 145, which is shown as flowers in a flower pot. By employing a fold-out or pop-up image, further excitement and visual enhancement is provided.

By employing this embodiment of the present invention, visually distinctive article holding system 20 incorporates a unique, exciting, and visually enhancing card assembly 140 integrally formed with article holding receptacle 136 in order to provide enhanced visual stimulation and excitement, in addition to the gift contained within article holding system 20.

In FIGS. 30 through 41, further additional embodiments of the present invention are depicted. By referring to FIGS. 30 through 41, along with the following detailed disclosure, the construction and operation of these further alternate embodiments will best be understood. As is evident from these additional embodiments, it is apparent that the present invention encompasses article holding receptacles which are formed as generally open bags as well as closed bags or closed boxes. As detailed below, by employing these further alternate embodiments and employing heavier gauge or weight paper or cardboard, the article holding system of the present invention can function either as a bag or a box.

In FIGS. 30–32, two alternate embodiments for unique, visually distinctive article holding system 20 of the present invention are detailed. In these two embodiments, article holding system 20 comprises article holding receptacle 150, which is constructed in a manner visually depicting any desired animal, character, or object. In this embodiment, the overall body or shape of the animal, character, or object is formed by article holding receptacle 150. For exemplary purposes, article holding receptacle 150 is depicted in FIGS. 30–32 as a teddy bear.

As is evident from this embodiment and the further embodiments shown in FIGS. 33–41, the present invention encompasses the previous embodiments, wherein a visually distinctive, exciting and interest generating visual image was depicted on the surface of the bag, as well as the embodiments detailed below, and shown in FIGS. 30–41, wherein article holding system 20 is constructed to visually represent a particular character, animal, or structure by employing the overall elements forming the box or bag formed thereby. In this way, a further unique, visually distinctive, exciting and interest generating article holding system 20 is attained, providing a visual impact heretofore unattainable with any prior art bag or box.

In FIGS. 30 and 31, article holding system 20 comprises article holding receptacle 150 which incorporates a front panel 151 and a rear panel 152. In addition, side panels 153 and 154 are employed and are constructed extending between and interconnecting front panel 151 with rear panel 152. The construction of article holding receptacle 150 is completed by a bottom plate 155 which interconnects the lower edges of panels 151, 152, 153, and 154. In this way, an interior article holding chamber or zone is formed for providing the desired item or article holding capabilities.

In order to provide the desired unique, distinctive, and exciting visual image, panels 151, 152, 153, and 154 are dimensioned to establish the visual representation of a sitting teddy bear. In order to attain this visual impression, front panel 151 and rear panel 152 are longitudinally tapered having a greater width at the bottom than at the top, while side panels 153 and 154 are constructed with preformed folded zones which extend outwardly, in order to provide the visual appearance of the teddy bear's bulging sides.

Finally, in order to assure that a visually distinctive exciting and interest generating image is attained and an observer immediately recognizes article holding receptacle 150 as a sitting teddy bear, various visually distinctive add-ons are affixed to various portions of article holding receptacle 150. As best seen in FIG. 30, these add-ons include cut-out portions 156 and 157, which represent the feet of the teddy bear, cut-out portion 158 which represents the arms of the teddy bear, and cut-out portion 159 which represents the face and ears of the teddy bear. By affixing portions 156, 157, 158, and 159 to the appropriate locations on article holding receptacle 150, a unique, visually distinctive, exciting and interest generating teddy bear image is realized in the form of article holding receptacle 150.

Furthermore, by forming article holding receptacle 150 from material having a greater thickness, weight, or durability, article holding receptacle 150 functions both as a container for any desired gift item or article as well as being employed as a display item which can be retained by the recipient and placed on display for providing further enjoyment and visual stimulation to the recipient.

In the embodiment depicted in FIGS. 30 and 31, cut-out portion 159, which represents the face and ears of the teddy bear, is affixed to front panel 151. In addition, front panel 151 and rear panel 152 are constructed with a cut-out zone 160 formed in each panel to establish a handle member for ease of carrying any article or gift placed within receptacle 150. In this way, article holding receptacle 150 is easily transported and, if desired, the top portion thereof can be essentially closed or sealed.

In the alternate embodiment, depicted in FIG. 32, front panel 151 and rear panel 152 do not incorporate cut-out zone 160. Instead, panel 159 is affixed to the top edge of rear panel 152, and is pivotable relative thereto. In addition, fastening means 161, such as hook and loop fasteners, are placed on front panel 151 and the back surface of cut-out portion 159, thereby enabling cut-out portion 159 to be pivotable relative to rear panel 152 to a position closing article holding receptacle 150, while simultaneously positioning cut-out portion 159 where desired on front panel 151. In this way, a closable article holding receptacle 150 is attained, while assuring that the visually distinctive, exciting and interest generating image of the teddy bear is provided by article holding receptacle 150.

Figure 33:
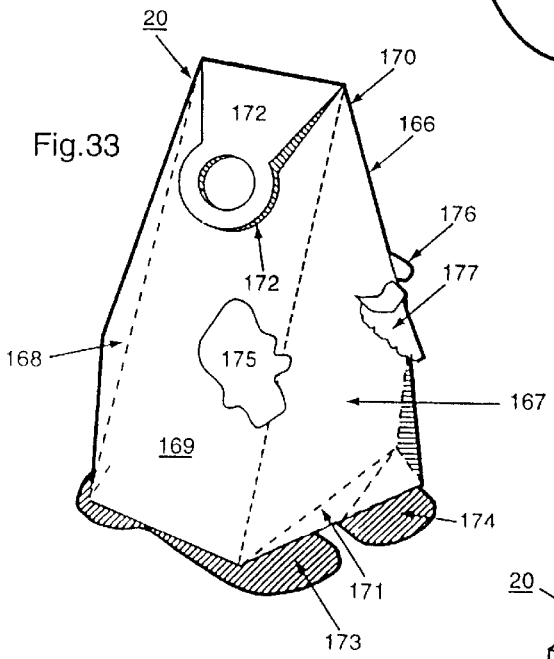
FIG. 33 is a front perspective view of a further alternate embodiment of the article holding system of the present invention wherein the system is constructed for visually representing a particular animal, character, or object substantially in its entirety.

In FIG. 33, a further alternate embodiment of article holding system 20 of the present invention is depicted. In this embodiment, article holding receptacle 166 is formed in a manner similar to article holding receptacle 150, incorporating a front panel 167, a rear panel 168, and two side panels 169 and 170. In addition, a bottom plate 171 is also incorporated which interconnects the bottom edge of panels 167, 168, 169, and 170. In this way, an internal retaining zone is formed for providing the desired article holding capabilities.

In this embodiment, article holding receptacle 166 is formed with panels 167, 168, 169, and 170 formed to create the visual, unique, distinctive, interest-generating image of any desired character, such as an elf, Santa Claus, etc. In one embodiment of this invention, the panels are cut and formed to create an elongated article holding receptacle, which can be conveniently employed for holding liquor bottles and the like.

In order to further enhance this capability, side panels 169 and 170 each incorporate a handle portion 172, which independently extends from each panel and incorporates a handle portion formed therein to enable article holding receptacle 166 and the article retained therein to be easily transported. Furthermore, in the preferred construction, portions 172 are integrally formed with their respective panel members, along with a folded line or zone in order to allow portions 172 to be folded, so as not to detract from the visual appearance of the character represented by article holding receptacle 166.

In order to provide the desired visually distinctive, exciting and interest-generating image formed by article holding receptacle 166, this embodiment of the present invention employs front panel 167 and rear panel 168 with preformed fold lines incorporated therein, which are constructed to extend outwardly in order to provide article holding receptacle 166 with an overall form consistent with the desired character represented by article holding receptacle 166. In addition, image-enhancing cut-out portions are also employed, as detailed above in reference to FIGS. 30–32.

In this embodiment, cut-out portions 173 and 174 are affixed to bottom plate 171 to function as the feet of the character, while cut-out portion 175 is affixed to side panel 169 and cut-out portion 176 is affixed to side panel 170 representing the arms of the character. Finally, other feature enhancements, such as cut-out portion 177 representing a mustache and beard is affixed to front panel 167 cooperating with the visual indicia printed on front panel 167.

In this way, article holding receptacle 166 provides the desired, unique, visually distinctive, exciting and interest generating image completely formed by the article holding receptacle itself, providing excitement and interest heretofore unattainable with prior art systems. In addition, as detailed above, article holding receptacle 166 may be formed from heavy weight or gauge material, so as to enable long-term use, as well as display of article holding receptacle 166 for extended enjoyment and enhanced appreciation.

Figure 34:
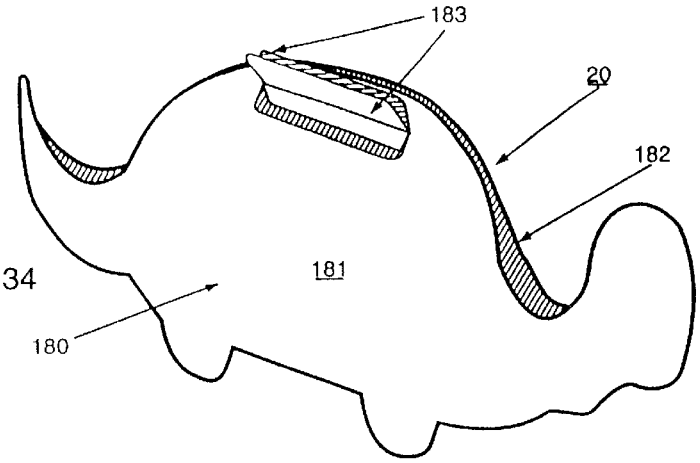
FIG. 34 is a front perspective view of a still further alternate embodiment of the article holding system of the present invention in an embodiment depicted in its closed position and constructed for retaining any desired article, gift, or item as well as being employed as a display.
Figure 35:
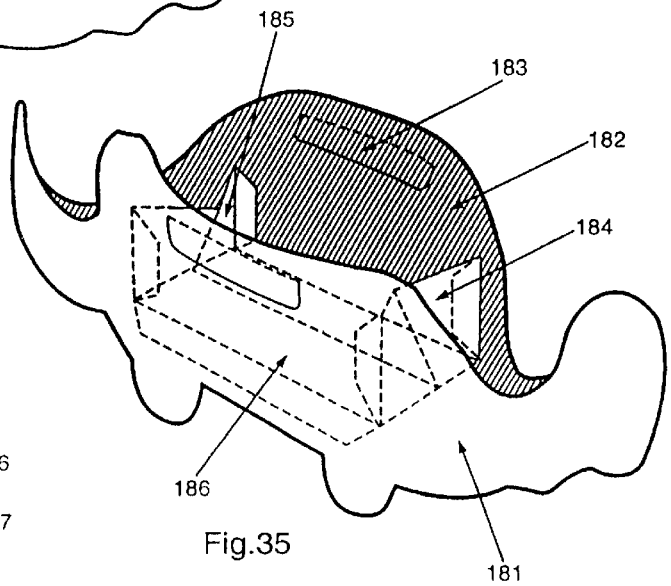
FIG. 35 is a front perspective view of the article holding system of FIG. 34 depicted in its open configuration.

In FIGS. 34 and 35, a further alternate embodiment of article holding system 20 of the present invention is depicted. In this embodiment, article holding system 20 comprises article holding receptacle 180. Article holding receptacle 180 comprises a self-contained gift, item or article holding member which performs all of the functions of a box or bag in a substantially enhanced, unique, distinctive, exciting and interest generating manner.

In this embodiment, article holding receptacle 180 incorporates a front panel 181 and a cooperating rear panel 182, both of which are formed with a substantially identical overall size and shape. For exemplary purposes, front panel 181 and rear panel 182 are depicted in FIGS. 34 and 35 as representing a turtle.

In order to provide the desired visual excitement and interest, the surfaces of panels 181 and 182 are preferably brightly colored and distinctly decorated to represent the side of a turtle. In addition, handle forming flaps 183 are also preferably formed along an upper edge of panels 181 and 182 in order to enable article holding receptacle 182 to be closed, with the desired article being retained therein and easily carried.

In order to enable article holding receptacle to 180 provide the desired article, gift or item retaining capabilities, side panels 184 and 185 are mounted along the inside surfaces of panels 180 and 181 with side panels 184 and 185 extending between and interconnecting panels 181 and 182. In the preferred construction, side panels 184 and 185 incorporate preformed folds therein and are affixed directly to the inside surfaces of panels 181 and 182.

In addition, a bottom plate 186 is also preferably affixed directly to the inside surfaces of panels 181 and 182 extending between panels 181 and 182, as well as side panels 184 and 185. In addition, bottom plate 186 also preferably incorporates preformed fold lines therein.

In this way, article holding receptacle 180 provides the desired internal retaining zone, formed by side panels 184 and 185 and bottom plate 186, establishing article holding receptacle 180, which is visually distinctive exciting and interest generating while also providing the desired article holding capabilities. In addition, by incorporating preformed folds in side panel 184 and in bottom plate 186, article holding receptacle 180 can be easily folded when not in use, if storage thereof is desired.

Article holding receptacle 180 also may be constructed from heavier weight or gauge material so as to provide both article holding capability as well as being longer lasting and durable so as to function as a display. In this way, article holding receptacle 180 can be enjoyed for extended periods of time as a toy or other display item.

Furthermore, as is evident from the foregoing detailed disclosure, article holding receptacle 180 may be formed to represent any desired animal, character, or object by employing the construction detailed herein. In this way, a wide variety of visually distinctive, exciting and interest generating article holding receptacles are easily constructed for use as both a retaining member, for use in giving gifts of any type, as well as being used as an exciting, visually distinctive and interest generating display member.

Figure 36:
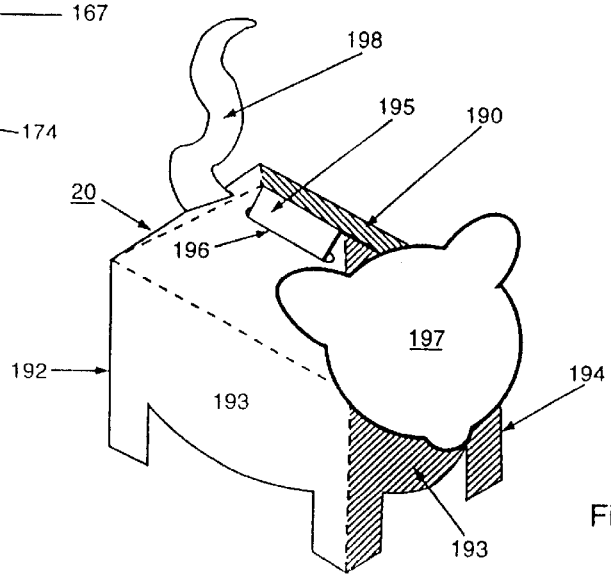
FIG. 36 is a front perspective view of a further alternate embodiment of the article holding system of the present invention depicting a particular animal, character, or object substantially in its entirety, and shown in a closed configuration.

In FIG. 36, a further alternate embodiment of article holding system 20 of the present invention is depicted, comprising article holding receptacle 190. In this embodiment, article holding receptacle 190 is constructed with an overall structure substantially equivalent to the visual appearance of the character, animal, or object being represented thereby. For exemplary purposes, article holding receptacle 190 is depicted in the form of a pig.

In this embodiment, article holding receptacle 190 incorporates a front panel 191, a rear panel 192, and side panels 193 and 194. In order to provide the desired visually distinctive, exciting and interest generating image for this embodiment, panels 191, 192, 193, and 194 are formed with a size and shape consistent with the size and shape of the animal, character, or object being represented. As depicted in FIG. 36, these panels are formed with an overall configuration representing the size and shape of a pig.

In the preferred construction of article holding receptacle 190, each panel member 191, 192, 193, and 194 incorporates an extension portion along the top edge thereof which are formed for cooperating interengagement with each other. In this way, the top of article holding receptacle 190 can be closed by foldingly interengaging the extension portions of each of the panel members and, as depicted in FIG. 36, inserting a locking tab 195 in a receiving slot 196. By employing this construction, along with a bottom plate (not shown) interconnecting each of the inside surfaces of the panel members, a box-type construction is attained which is capable of retaining any desired gift and being closed in a generally conventional manner consistent with a box-type construction.

In order to provide the final visually distinctive representations to article holding receptacle 190, cut-out portion 197, representing the face of the pig, and 198, representing the head of the pig, are mounted on the respective panel portions to complete the construction of article holding receptacle 190. By employing this construction, a unique, visually distinctive, exciting and interest generating article holding receptacle is realized which can be employed for any desired gift, item, or article.

With article holding receptacle 190 being completely closed, items can be placed directly in article holding receptacle 190 and enclosed therein for protecting the articles from unwanted exposure. As a result, any desired items can be conveniently placed in article holding receptacle 190 for presentation to a recipient. Regardless of the article being placed within article holding receptacle 190, this embodiment of the present invention, like the embodiments previously disclosed, all provide a unique, visually distinctive, exciting and interest generating image to enhance the receipt thereof as well as being constructed in a manner which enables the article holding receptacle to be used subsequently for display or by children for play.

Figure 37:
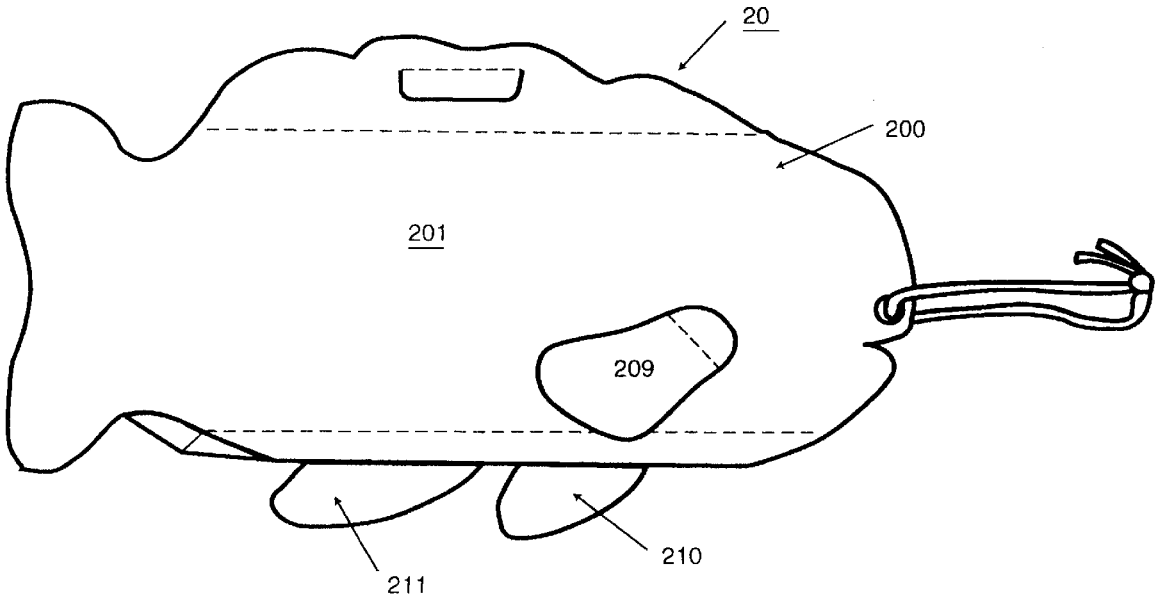
FIG. 37 is a front elevation view of a still further alternate embodiment of the article holding system of the present invention depicted fully assembled and ready for use.
Figure 38:
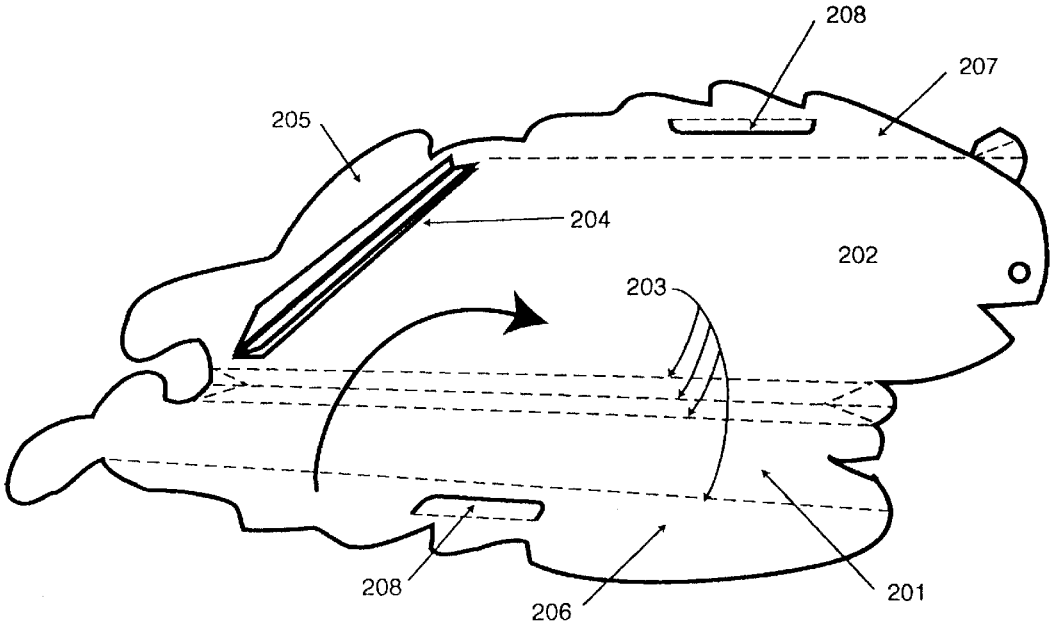
FIG. 38 is a perspective view of the article holding system depicted in FIG. 37 and shown unassembled in a substantially planar configuration.

In FIGS. 37 and 38, a still further alternate embodiment of article holding system 20 of the present invention is depicted. In this embodiment, article holding system 20 comprises article holding receptacle 200 which employs integrally formed cooperating panel members to attain a fully assembled, peripherally surrounding and enclosing article holding member. As depicted, article holding receptacle 200 visually represents a fish, but may be formed to represent any desired animal, character, or object.

In this embodiment, article holding receptacle 200 comprises a front panel 201, a rear panel 202, and a first side panel 203 integrally connected with panels 201 and 202. Integrally connected side panel 203 preferably contains a plurality of preformed folds therein in order to enable panels 201 and 202 to be folded together for storage, as well as easily expanded to provide and establish an article holding zone between panels 201 and 202.

Similarly, a prefolded base plate 204 is affixed to panel 202 adjacent side panel 203 to provide the requisite bottom surface for article holding receptacle 200 and assure that the desired gift or item placed therein is retained. In the preferred construction, bottom plate 204 also incorporates a cooperating extension portion 205 which is constructed for mating interengagement and affixation to a cooperating portion of front panel 201. In this way, when panel 201 is folded, in order to form the desired article holding receptacle 200, extension portion 205 contacts one edge of panel 201 and is affixed thereto to establish the desired construction.

In this embodiment, front panel 201 also incorporates an extension portion 206 along the edge thereof opposed from side panel 203, while rear panel 202 also incorporates an extension portion 207 along the edge thereof opposed from side panel 203. In addition, both extension portions 206 and 207 also preferably incorporate flap members 208 which cooperate to form a carrying handle for article holding receptacle 200.

In this embodiment, article holding receptacle 200 is constructed in a single substantially flat sheet of material, and, when desired, is folded and easily assembled for creating article holding receptacle 200. In order to achieve the desired article holding receptacle, front panel 201 is folded over rear panel 202 so as to be in juxtaposed, spaced, overlying relationship therewith. By moving panel 201 into cooperating juxtaposed, spaced relationship with panel 202, side panel 203 forms the side edge of article holding receptacle 200.

The opposed side edge is established by contacting extension portion 206 with extension portion 207 and securing the extension portions to each other by interlocking the cooperating handle-forming flap members 208. Finally, base plate 204 is established and affixed in position by securely affixing extension portion 205 to the cooperating portion of the inside surface of panel 201.

Once completed, a unique, visually distinctive, exciting, and interest generating article holding receptacle 200 is established providing a unique, visually distinctive image, depicted in FIGS. 37 and 38 as a fish. Once assembled, article holding receptacle 200 is able to easily retain any desired gift or item therein. In the construction depicted, elongated items, such as bottles and the like, are easily retained in article holding receptacle 200 by being inserted through the "nose" of the fish, where the ends are open. If desired, a string or rope can be affixed in a suitable cut-out zone formed in panels 201 and 202 in order to carry the article retained in holding receptacle 200.

In order to provide further a visually enhanced, distinctive nature to article holding receptacle 200, in addition to the decorative visual indicia printed thereon, cut-out portions 209, 210 and 211 are fixed to appropriate locations on panels 201, 202 and 203 to provide the visual impression of fins and gills. In this way, the desired, unique, visually distinctive and interest generating image is realized and the added excitement and interest generation being sought is attained.

In FIGS. 39 and 40, a further alternate embodiment of article holding system 20 is provided. In this embodiment, article holding system 20 is depicted as article holding receptacle 215 which is formed as an integrally constructed article retaining box incorporating a unique construction enabling article holding receptacle 215 to appear as a fish. As is evident from the foregoing discussion, article holding receptacle 215 can be constructed to visually represent any desired animal, character, or object without departing from the scope of this invention.

In this embodiment as well as in the embodiment detailed above in reference to FIGS. 30–38, the outside surface of the components forming each article holding receptacle are printed with bright, visually distinctive images detailing the character, animal, or object represented by the overall construction. In this way, the visual excitement and interest generated by these embodiments of the article holding receptacles are realized.

In this embodiment, article holding receptacle 215 preferably comprises a top panel 216, a bottom panel 217, and edge-forming panel 218, which is preferably affixed to, and integrally formed with panels 216 and 217. In addition, panel 216 also incorporates extension members 220, 221, and 222, each of which are interconnected with and extend from one of the three remaining edges of top panel 216. Similarly, bottom panel 217 incorporates extension members 223, 224, and 225, each of which are integrally formed with and extend from one of the free edges of bottom panel 217.

In the preferred embodiment, article holding receptacle 215 also incorporates an upstanding, substantially continuous wall member 230. Wall member 230 is preferably constructed for ease of foldability affixed to bottom panel 217 in juxtaposed, spaced relationship with the juncture of panel 216 with extension members 223, 224, and 225 and edge forming panel 218.

In the preferred construction, edge forming panel 218 extends between panels 216 and 217, defining a distance substantially equivalent to the height of wall member 230. In this way, when article holding receptacle 215 is to be formed from its folded state to its fully constructed state for use, wall member 230 is moved from its folded form to its fully erected form, with edge-forming panel 218 being folded upwardly so as to enable top panel 216 to be placed in juxtaposed, overlying, spaced relationship with bottom panel 217. Once in this final position, edge forming panel 218 is in contact with the adjacent portion of wall member 230, with each having substantially the same overall vertical height.

In addition, in the preferred construction, each of the extending members 220, 221, 222, 223, 224, and 225 incorporate a folded section which extends from the edge of plate 216 or plate 217 a distance substantially equivalent to one-half the vertical height of wall member 230 or one-half the width of edge-forming panel 218. As a result of this construction, substantially continuous, upstanding wall member 230 is easily moved from its folded position to its fully erected position, defining an internal retaining zone for the particular gift, article, or item to be contained within article holding receptacle 215. In addition, once upstanding wall member 230 has been raised to its fully erected position, panels 216 and 217, along with their extension members 220, 221, 222, 223, 224, and 225 are all easily assembled into the unique, visually exciting, distinctive article holding receptacle 215.

If desired, fastening means 231 can be mounted on extension portions 220, 221 and 223 in order to matingly interengage and seal with the cooperatingextension portions 223, 224, and 225. As depicted, fastening means 231 comprise adhesive strips which are easily affixed to a portion of extension portions 223, 224, and 225, when contacted therewith. Of course, any other suitable fastening means can be employed without departing from the scope of this invention.

In addition, each extension member 221 and 224 may incorporate a handle forming flap member 232 formed therein which is positioned for cooperating interengagement with each other to form a handle when article holding receptacle 215 is fully assembled. In this way, if desired, article holding receptacle 215 can be easily transported by merely holding the handle formed by cooperating flap member 232.

Finally, in order to further enhance the visual distinctive presentation and interest generating image created by article holding receptacle 215, article holding receptacle 215 may also incorporate cut-out portions 233, 234, and 235 which are affixed to appropriate surfaces thereof. In the construction shown in FIGS. 39 and 40, cut-out portions 233, 234, and 235 represent fins and gills of the fish depicted by article holding receptacle 215 and are affixed to appropriate surfaces for added visual enhancements to the overall unique and distinctive presentation provided by article holding receptacle 215.

In FIG. 41, a still further embodiment of the article holding system 20 of the present invention is depicted. In this embodiment, article holding system 20 comprises an article holding receptacle 250 which incorporates two principal decorative panels 251 and 252 along with a single side or intermediate panel 253. In addition, a bottom panel 254 is also incorporated, which interconnects the bottom edges of panels 251, 252, and 253.

In this embodiment, article holding receptacle 250 comprises a substantially triangular shape, with one edge of decorative panels 251 and 252 being affixed to each other, while the opposed edges thereof are affixed to side panel 253.

As with the embodiments detailed above, article holding receptacle 250 is constructed to visually depict a desired character, animal, or object. In this embodiment, the overall body or shape of the animal, character, or object formed by article holding receptacle 250 comprises a cat. As a result, decorative panels 250 and 251, along with side panel 253, are all constructed to provide the desired distinctive, exciting and interest generating visual image representing a cat.

As with several of the embodiments detailed above, this embodiment of the present invention also incorporates visually stimulating add-ons, principally cutout portion 255. Preferably, cutout portion 255 represents the face of the cat and is affixed to panels 251, 252, and 253 in order to further enhance and improve the unique, distinctive, visually exciting and interest generating image provided by article holding receptacle 250.

As with several of the embodiments detailed above, article holding receptacle 250 is preferably formed from material having a greater thickness, weight, or durability than would otherwise be employed in a conventional article holding container. In this way, article holding receptacle 250 can function as both an article holding receptacle, as well as being employed in its entirety as a long-term display item. As a result, additional enjoyment and visual stimulation is realized by the recipient or user.

In the embodiment of article holding receptacle 250 depicted in FIG. 41, decorative panels 251 and 252 incorporate cutout zones 256 which form handles therein. In this way, the visual representation provided on decorative panels 251 and 252 is enhanced as well as incorporating a readily accessible and easily employable handle for carrying article holding receptacle 250.

As is evident from the foregoing detailed disclosure, unique, distinctive, and interest generating article holding system 20 can be constructed in a plurality of alternate embodiments. Although several alternate embodiments have been fully disclosed, this disclosure does not encompass all of the embodiments in which the present invention can be implemented. Consequently, the embodiments detailed above are provided as examples of the plurality of constructions in which unique, distinctive, and interest generating article holding system 20 of the present invention may be formed. However, all alternate embodiments employing the teaching of this invention shall be considered to be within the scope of the present invention.

It will thus be seen that the objects set forth above, among those made apparent from the preceding description, are efficiently attained and, since certain changes may be made in the above product, without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim is new and desire to secure by Letters Patent is:

1. A decorative, visually stimulating display and holding system constructed for holding any desired object or gift and being used as a combined display item and greeting card holder, said display and holding system comprising A. a first and a second panel
  a. positioned in juxtaposed, spaced relationship with each other,
  b. comprising substantially the same overall dimensions, and
  c. said first panel incorporating a cut-out zone formed therein dimensioned for cooperating with a greeting card;

B. a first side panel and a second side panel, each
  a. being in juxtaposed, spaced relationship with each other,
  b. comprising substantially the same overall size and shape,
  c. interconnected with and extending between the first panel and the second panel, and
  d. incorporating fold lines therein for enabling the display and holding system to be easily folded for storage, C. a bottom panel extending between and being connected with the first and second panel within the first and second side panels, thereby establishing and defining an internal retaining zone within which the desired item or gift can be stored;

D. a first greeting card member movably positionable in juxtaposed, spaced relationship with the cut-out zone of the first panel, and E. a second card retaining and holding member cooperatively associated with the first panel for enabling said greeting card member to be securely retained in juxtaposed, spaced, relationship with the cut-out zone formed on said first panel; whereby a combined gift retaining and greeting card holding system is achieved which enables any desired greeting card member to be retained and displayed.

2. The decorative, visually stimulating display and holding system defined in claim 1 wherein said second card retaining and holding member is further defined as comprising an adhesive plate on which said card is mounted, said plate being constructed for enabling the card to be positioned and securely retained in spaced relationship with the cut-out zone of the first panel.

3. The decorative, visually stimulating display and holding system defined in claim 2, wherein said first panel further comprises a holding tab to retain the greeting card member in its closed position when mounted in the cut-out zone thereof.

4. The decorative, visually stimulating display and holding system defined in claim 1, wherein said cut-out zone is further defined as comprising a transparent cover and the card retaining and holding member is further defined as comprising a backing plate affixed to an interior surface of the first panel for establishing a card holding pocket and said first panel further comprises an elongated slit formed in juxtaposed relationship with the cut-out zone for enabling the greeting card member to be inserted and withdrawn from the pocket formed between the cut-out zone and the pocket forming backing plate.

5. A decorative, visually stimulating display and holding system constructed for holding any desired object or gift and being used as a combined display item and greeting card holder, said display and holding system comprising A. a first and second panel
  a. positioned in juxtaposed, spaced relationship with each other,
  b. comprising substantially the same overall dimensions, and
  c. Said first panel incorporation a cut-out zone formed therein dimensioned for cooperating with a greeting card;

B. a first side panel and a second side panel, each
  a. being in juxtaposed, spaced relationship with each other,
  b. comprising substantially the same overall size and shape,
  c. interconnected with and extending between the first panel and the second panel, and
  d. incorporating fold lines therein for enabling the display and holding system to be easily folded for storage, C. a bottom panel extending between and being connected with the first and second panel within the first and second side panels, thereby establishing and defining an internal retaining zone within which the desired item or gift can be stored;

D. a card retaining and holding member a. mounted to an interior surface of the first panel in juxtaposed, overlying relationship with the cut-out zone, b. peripherally surrounding a substantial portion of the cut-out zone, and c. establishing a greeting card holding pocket with said first panel; and E. a greeting card removably positionable in the holding pocket in juxtaposed, spaced relationship with the cut-out zone of the first panel, enabling a portion of the greeting card to be viewed through the cut-out zone.

6. The decorative, visually stimulating display and holding system defined in claim 5, wherein said card retaining and holding member comprises an open zone formed along at least one edge thereof for enabling the greeting card to be inserted therethrough into the holding pocket.

7. The decorative, visually stimulating display and holding system defined in claim 5, wherein said system further comprises:

F. a transparent sheet mounted to the interior surface of the first panel between the first panel and the card retaining and holding member for protecting a surface of the greeting card when retained in the holding pocket while enabling the surface thereof to be viewable.

8. The decorative, visually stimulating display and holding system defined in claim 5, decorative, visually stimulating display and holding system defined in claim 7, wherein said first panel comprises an elongated slit formed therein in juxtaposed, spaced relationship with the cut-out zone for enabling the greeting card to be inserted and withdrawn from the holding pocket.

9. The decorative, visually stimulating display and holding system defined in claim 5, wherein said cut-out zone is constructed for enabling a portion of the greeting card to be visible, thereby allowing the greeting card to be movable relative to the cut-out zone for revealing the indicia on the greeting card in separate intervals.

* * * * *